US007781136B2

(12) United States Patent
Ohmura et al.

(10) Patent No.: US 7,781,136 B2
(45) Date of Patent: Aug. 24, 2010

(54) TONER AND PRODUCTION METHOD OF THE SAME

(75) Inventors: Ken Ohmura, Tokyo (JP); Hiroshi Yamazaki, Tokyo (JP)

(73) Assignee: Konica Minolta Business Technologies, Inc., Tokyo, Japan Tokyo (JP)

( * ) Notice: Subject to any disclaimer, the term of this patent is extended or adjusted under 35 U.S.C. 154(b) by 428 days.

(21) Appl. No.: 11/960,133

(22) Filed: Dec. 19, 2007

(65) Prior Publication Data

US 2008/0171280 A1 Jul. 17, 2008

(30) Foreign Application Priority Data

Jan. 17, 2007 (JP) ..... 2007-007918

(51) Int. Cl.
*G03G 9/087* (2006.01)

(52) U.S. Cl. ..... 430/109.4; 430/137.22

(58) Field of Classification Search ..... 430/109.4, 430/137.22
See application file for complete search history.

(56) References Cited

U.S. PATENT DOCUMENTS 6,756,171 B2 * 6/2004 Roh et al. ..... 430/109.4
7,244,538 B2 * 7/2007 Sakata et al. ..... 430/109.1

FOREIGN PATENT DOCUMENTS

JP 2005266317 9/2005
JP 2006251074 9/2006

* cited by examiner

*Primary Examiner*—John L Goodrow
(74) *Attorney, Agent, or Firm*—Lucas & Mercanti, LLP

(57) ABSTRACT

A toner comprising toner particles containing a colorant and a binder resin, the binder resin comprising a polyester resin, wherein the polyester resin comprises at least a polyester segment containing an aromatic dial component, the polyester segment being derived from an aromatic diol and a dicarboxylic acid, wherein a content of the polyester segment containing an aromatic dial component is higher in a surface-portion of the toner particle than in a central portion of the toner particle.

10 Claims, No Drawings

TONER AND PRODUCTION METHOD OF THE SAME

This application is based on. Japanese Patent Application No. 2007-007918 filed on Jan. 17, 2007 in Japanese Patent Office, the entire content of which is hereby incorporated by reference.

FIELD OF THE INVENTION

The present invention relates to a toner employed for an image forming method based on an electrophotographic method, and a production method thereof.

BACKGROUND OF THE INVENTION

In recent years, image forming apparatuses based on electrophotographic methods have been used as common copiers and printers in offices to print documents as well as for simple copying, and moreover have expanded their application to the area of preparing printed materials used outside offices, specifically to the print-on-demand (POD) market, which is included in the quick-printing market, since variable information from electronic data is readily printed. Accordingly, various copiers and printers have been installed in offices, resulting in increased power consumption as a whole.

In image forming apparatuses based on electrophotographic methods, since the most power is consumed during the fixing treatment, devices which require less energy in the fixing treatment have been in demand.

To realize energy conservation as described above, various proposals have been made so that enhanced low-temperature fixability can be realized via a toner composed of a binder resin exhibiting a low softening temperature. However, the toner composed of a binder resin exhibiting a low softening temperature has the problem of poor heat-resistant storage properties.

Further, in image forming based on electrophotographic methods, formation of color images, specifically formation of high quality color images exhibiting gloss to some extent or more has been in high demand.

There has been disclosed a binder resin composed of a crystalline polyester resin for use in a toner to form high quality color images (for example, refer to Patent Document 1). Further, there has been proposed a technique to realize enhanced low-temperature fixability via a urea-modified polyester resin as the polyester resin (refer, for example, to Patent Document 2).

However, in the POD market, high-speed printing is emphasized. Of course, a toner needs to be certainly fixed even in high-speed printing, but the following problems exist: high-speed fixability can not be achieved via the above toner employing a crystalline polyester resin, and further adequate high-speed fixability can not be achieved even via a toner featuring a structure wherein the core particle composed of the crystalline polyester resin is coated with a highly viscoelastic amorphous polyester resin.

Further, even though the toner employing a urea-modified polyester resin makes it possible to achieve low-temperature fixability, there is still the problem in that heat-resistant storage properties are degraded due to the decrease in crystallinity via urea modification.

(Patent Document 1) Japanese Patent Application Publication open to Public Inspection (hereinafter referred to as JP-A) No. 2006-91378

(Patent Document 2) JP-A No. 2005-250303

SUMMARY OF THE INVENTION

In view of the foregoing, an object of the present invention is to provide a toner exhibiting enhanced low-temperature fixability and high-speed fixability as well as excellent heat-resistant storage properties, and a production method thereof.

One of the aspects to achieve the above object of the present invention is a toner comprising toner particles containing a colorant and a binder resin, the binder resin comprising a polyester resin, wherein the polyester resin comprises at least a polyester segment containing an aromatic diol component, the polyester segment being derived from an aromatic diol and a dicarboxylic acid, wherein a content of the polyester segment containing an aromatic diol component is higher in a surface-portion of the toner particle than in a central portion of the toner particle.

DESCRIPTION OF THE PREFERRED EMBODIMENTS

The inventors of the present invention have conducted diligent investigation and found that relatively high image hardness as well as low-temperature fixability and heat-resistant storage properties of the toner were realized via a toner structure in which a polyester segment containing an aromatic diol component was allowed to exist at a higher ratio near the surface than in the central portion, although the polyester resin in which a polyester segment containing an aromatic diol component is contained features no crystalline structure, whereby the present invention was achieved.

The toner of the present invention incorporates toner particles containing a binder resin composed of a polyester resin and a colorant, wherein the polyester resin constituting the binder resin contains at least a polyester segment containing an aromatic diol component obtained from an aromatic dial and a dicarboxylic acid, wherein the degree of existence of the polyester segment containing an aromatic diol component is higher near the surface than in the central portion of the toner particle.

In the toner of the present invention, it is preferable that the polyester resin constituting the hinder resin is a urea-modified polyester resin.

One embodiment of the method of producing a toner of the present invention is characterized in that: the method contains the steps of:

(i) dispersing polyester composition (a1) in an aqueous medium, polyester composition (a1) comprising a colorant, a solvent and central-portion forming polyester (a) which comprises at least a polyester segment containing an aromatic diol component, wherein the polyester segment is derived from an aromatic diol and a dicarboxylic acid, whereby an aqueous dispersion of oil droplets containing central-portion forming polyester (a) and the colorant is obtained; and (ii) adding surface-portion forming composition (B1) to the aqueous dispersion, surface-portion forming composition (B1) comprising an amine cross-linking agent, a solvent and isocyanate modified surface-portion forming polyester (B) which comprises at least the polyester segment containing the aromatic diol component, whereby central-portion forming polyester (a) is covered by isocyanate modified surface-portion forming polyester (B) to form toner particles, wherein a content of the polyester segment containing an aromatic diol component is higher in isocyanate modified surface-portion forming polyester (B) than in central-portion forming polyester (a).

It is preferable that the method further contains the step of aggregating the oil droplets after above step (i).

Another embodiment of the method of producing a toner of the present invention is characterized in that: the method contains the steps of:

(i) dispersing polyester composition (a2) in an aqueous medium, polyester composition (a2) comprising a colorant, an amine cross-linking agent, a solvent and central-portion forming polyester (a) which comprises at least a polyester segment containing an aromatic dial component, wherein the polyester segment is derived from an aromatic dial and a dicarboxylic acid, whereby an aqueous dispersion of oil droplets containing central-portion forming polyester (a) and the colorant is obtained; and (ii) adding surface-portion forming composition (B2) to the aqueous dispersion, surface-portion forming composition (B2) comprising a solvent and isocyanate modified surface-portion forming polyester (B) which comprises at least the polyester segment containing the aromatic diol component, whereby central-portion forming polyester (a) is covered by isocyanate modified surface-portion forming polyester (B) to form toner particles, wherein a content of the polyester segment containing an aromatic dial component is higher in isocyanate modified surface-portion forming polyester (B) than in central-portion forming polyester (a).

It is preferable that the method further contains the step of aggregating the oil droplets after above step (i).

Another embodiment of the method of producing a toner of the present invention is characterized in that: the method contains the steps of:

(i) dispersing polyester composition (A1) in an aqueous medium, polyester composition (A1) comprising a colorant, a solvent and isocyanate modified central-portion forming polyester (A) which comprises at least a polyester segment containing an aromatic dial component, wherein the polyester segment is derived from an aromatic diol and a dicarboxylic acid, whereby an aqueous dispersion of oil droplets containing isocyanate modified central-portion forming polyester (A) and the colorant is obtained; and (ii) adding surface-portion forming composition (b1) to the aqueous dispersion, surface-portion forming composition (b1) comprising a solvent, an amine cross-linking agent and surface-portion forming polyester (b) which comprises at least the polyester segment containing the aromatic diol component, whereby isocyanate modified central-portion forming polyester (A) is covered by surface-portion forming polyester (b) to form toner particles, wherein a content of the polyester segment containing an aromatic diol component is higher in surface-portion forming polyester (b) than in isocyanate modified central-portion forming polyester (A).

It is preferable that the method further contains the step of aggregating the oil droplets after above step (i).

Another embodiment of the method of producing a toner of the present invention is characterized in that: the method contains the steps of:

(i) dispersing polyester composition (A2) in an aqueous medium, polyester composition (A2) comprising a colorant, an amine cross-linking agent, a solvent and isocyanate modified central-portion forming polyester (A) which comprises at least a polyester segment containing an aromatic diol component, wherein the polyester segment is derived from an aromatic diol and a dicarboxylic acid, whereby an aqueous dispersion of oil droplets containing isocyanate modified central-portion forming polyester (A) and the colorant is obtained; and (ii) adding surface-portion forming composition (b1) to the aqueous dispersion, surface-portion forming composition (b1) comprising a solvent and surface-portion forming polyester (b) which comprises at least the polyester segment containing the aromatic diol component, whereby isocyanate modified central-portion forming polyester (A) is covered by surface-portion forming polyester (b) to form toner particles, wherein a content of the polyester segment containing an aromatic diol component is higher in surface-portion forming polyester (b) than in isocyanate modified central-portion forming polyester (A).

It is preferable that the method further contains the step of aggregating the oil droplets after above step (i).

The toner of the present invention contains, as a binder resin, a polyester resin exhibiting a specific concentration gradient structure in which the content of a polyester segment containing an aromatic diol component is higher near the surface of the toner particle than in the central portion of the toner particle. Accordingly, the toner particle exhibits adequate low-temperature fixability as a whole, due to the effect of the polyester resin exhibiting relatively low melt viscosity, existing in the central-portion of the toner particle.

Further, a polyester resin containing a polyester segment containing an aromatic diol component, which exhibits an amorphous structure, does not show drastic decrease in viscoelasticity even at a higher temperature and maintains a certain level of melt viscoelasticity, resulting in causing no high-temperature offset phenomena, which is quite different from the property of a so-called crystalline polyester. Accordingly, an adequate separativity is obtained in the fixing process, resulting in enabling high-speed fixing. In addition, the toner particle does not have a so-called core-shell structure in which amorphous polyester exists only near the surface of the toner particle, but has a specific concentration gradient structure, whereby adequate low-temperature fixability and enhanced heat-resistant storage properties can be obtained, while suppressing occurrence of high-temperature offset phenomena.

The reason why the toner of the present invention exhibits enhanced heat-resistant storage properties is presumed as follows: The polyester resin containing a polyester segment containing an aromatic diol component exhibits an amorphous structure which is a molecular structure having no sharp melting point unlike a crystalline polyester resin. Accordingly, even when the polyester resin exhibits broad molecular weight distribution, molecular motion attributed to the molecular structure tends not to occur until the temperature increases as high as the glass transition temperature, and also no readily meltable low-molecular weight component tend not to be generated, resulting in providing an excellent heat-resistant storage properties.

The toner of the present invention contains a toner particle containing a colorant and a binder resin incorporating a polyester resin, and the polyester resin constituting the binder resin contains at least a polyester segment containing an aromatic diol component obtained from an aromatic diol and a dicarboxylic acid, wherein a specific concentration gradient structure is attained in which the content of the polyester segment containing an aromatic diol component is higher near the surface of the toner particle than in the central portion of the toner particle.

The specific concentration gradient structure is realized via formation of a toner particle as follows: as a (urea-modified) polyester resin forming the central portion of the toner particle, a polyester containing a polyester segment containing an aromatic diol component, at a low content (hereinafter also referred to as "a low content aromatic diol-containing polyester") is utilized; and as a (urea-modified) polyester resin forming the surface-portion of the toner particle, there is utilized a polyester containing a polyester segment containing an aromatic diol component, at a relatively high ratio (hereinafter also referred to as "a high content aromatic diol-containing polyester") compared with the low content aromatic diol-containing polyester.

Further, when an aromatic diol component containing-polyester resins having the same content of the polyester segment containing an aromatic diol component is utilized as the (urea-modified) polyester resin forming the central portion of the toner and the (urea-modified) polyester resin forming the surface-portion thereof, both a polyester containing an aromatic diol component and a crystalline polyester are utilized at the same time as a polyester resin which form the (urea-modified) polyester resin forming the central portion, whereby a specific concentration gradient structure may also be realized.

(Binder Resin)

A polyester resin constituting the binder resin described above is preferably a urea-modified polyester resin.

The binder resin is preferably a urea-modified polyester resin, since the existence of a urea bond makes it possible to reduce the property of the polyester resin that the polyester resin tends to be negatively charged, and therefore the obtained toner tends not to be excessively charged, exhibiting high charge stability as well as high adhesion to a recording material. Further, a urea-modified polyester resin is preferable as a binder resin also from another point of view that the crushing resistance of the toner particle is enhanced because both an ester bond and a urea bond coexist in the molecule, whereby the internal aggregation force in the toner particle is enhanced.

The toner, featuring that the binder resin is a urea-modified polyester resin, will now be described.

The urea-modified polyester resin for use in the present invention may be obtained as follows: initially, by allowing a polyvalent isocyanate compound to react with a polyester such as a polyester containing an aromatic diol component or a crystalline polyester, an isocyanate-modified polyester, being a polyester modified with isocyanate, is prepared, and thereafter by allowing a polyamine, being an amine cross-linking agent, to react with thus prepared isocyanate-modified polyester for urea-bond formation, whereby there is realized a state where the polyester molecule is expanded via the urea bond and at same time the isocyanate group remains at the terminal of the molecule. Via preparation of the urea-modified polyester resin in this way, both a polyester resin containing a urea bond and an isocyanate group are formed simultaneously, resulting in ensured reactivity.

(Polyester Containing Aromatic Diol Component)

A polyester containing an aromatic diol component utilized to form the binder resin for use in the toner of the present invention is synthesized via polycondensation, wherein constituent monomer components are at least a diol component containing an aromatic diol component and a dicarboxylic acid component containing a dicarboxylic acid. Thus prepared polymer has an amorphous structure, exhibiting no melting point in a specific temperature range, but having a glass transition temperature (Tg) and a softening temperature, as detailed below.

An aromatic diol forming such as a polyester containing an aromatic diol component includes, for example, bisphenols such as bisphenol A or bisphenol F and ethylene oxide adducts thereof, alkylene oxide adducts of bisphenols such as propylene oxide adducts thereof.

These may be utilized individually or in combination.

As the diol composition, an aliphatic diol may be utilized in combination with an aromatic diol. The aliphatic diol includes, for example, ethylene glycol, diethylene glycol, triethylene glycol, 1,2-propylene glycol, 1,3-propylene glycol, 1,4-butane diol, 1,4-butene diol, neopentyl glycol, 1,5-pentane glycol, 1,6-hexane glycol, 1,7-heptane glycol, 1,8-octane diol, 1,9-nonane diol, 1,10-decane dial, 1,4-cyclohexane diol, and dipropylene glycol.

When using the aliphatic diol in combination with an aromatic diol, it is preferable that the ratio of the aromatic dial to the entire dial composition is at least 50% by weight. When the ratio of the aromatic dial to the entire dial component is less than 50% by weight, no appropriate melt viscosity is realized, whereby high-temperature offset phenomena occur, resulting in the possibility of insufficient high-speed fixability.

Further, to adjust the melting point of the urea-modified polyester resin obtained, a minute amount of a polyol component composed of an aliphatic polyol of at least trivalent such as glycerin, trimethylolethane, trimethylolpropane, pentaerythritol, or sorbitol may be utilized as a constituent monomer component in combination with a dial component such as the above aromatic diol.

A dicarboxylic acid component forming the polyester containing an aromatic dial component includes aliphatic dicarboxylic acids such as oxalic acid, malonic acid, succinic acid, glutaric acid, adipic acid, spelic acid, azelaic acid, sebacic acid, pymelic acid, citraconic acid, maleic acid, fumaric acid, itaconic acid, glutaconic acid, isododecyl succinic acid, isododecenyl succinic acid, n-dodecyl succinic acid, n-dodecenyl succinic acid, n-octyl succinic acid, or n-octenyl succinic acid; and acid anhydrides thereof or acid chlorides thereof. Further, in addition to these aliphatic dicarboxylic acids, there are exemplified aromatic dicarboxylic acids such as phthalic acid, isophthalic acid, terephthalic acid, or naphthalene dicarboxylic acid.

These may be utilized individually or in combination.

Further, to realize an appropriate melt viscosity of a urea-modified polyester resin obtained, a polyvalent carboxylic acid component composed of a polyvalent carboxylic acid of at least trivalent such as trimellitic acid or pyromellitic acid may be utilized as a constituent monomer component in combination with the dicarboxylic acid component.

With regard to the ratio of a diol component (or the total component combined with a polyol component) to a dicarboxylic acid (or the total component combined with a polyvalent dicarboxylic acid component) used to synthesize the polyester containing an aromatic diol component, the equivalent ratio (OH)/(COOH) of a hydroxyl group (OH) of the diol component to a carboxyl group (COOH) of the dicarboxylic acid component is preferably from 1.5/1-1/1.5, more preferably from 1.2/1-1/1.2.

When the ratio of the diol component to the dicarboxylic acid component used falls within the ranges, the polyester containing an aromatic diol component featuring the desired molecular weight can be certainly obtained.

A polyvalent isocyanate compound which isocyanate-modifies the polyester containing an aromatic diol component includes aliphatic polyvalent isocyanates such as tetramethylene isocyanate, hexamethylene diisocyanate, or 2,6-isocyanate methylcaproate; alicyclic polyvalent isocyanates such as isophorone diisocyanate or cyclohexylmethane diisocyanate; aromatic diisocyanates such as α,α,α',α'-tetramethylxylylene diisocyanate; isocyanurates; phenol derivatives of these polyvalent isocyanate compounds; and those prepared by blocking these polyvalent isocyanate compounds with an oxime or a caprolactam.

These may be utilized individually or in combination.

The glass transition temperature (Tg) of the polyester containing an aromatic diol component described above is preferably from 20-90° C., more preferably from 35-65° C.

Further, the softening temperature of this polyester containing an aromatic diol component is preferably from 80-220° C., more preferably form 80-150° C.

Herein, the glass transition temperature (Tg) of the a polyester containing an aromatic diol component is determined using differential scanning calorimeter "DSC-7" (produced by Perkin Elmer, Inc.) and thermal analyzer controller "TAC7/DX" (produced by Perkin Elmer, Inc.). Specifically, 4.5 mg of an aromatic diol-containing polyester is sealed in an aluminum pan (Kit No. 0219-0041) and placed in a DSC-7 sample holder. An empty aluminum pan is used as the reference measurement. Subsequently, heating-cooling-heating temperature control is carried out over a measurement temperature range of 0-200° C. under measurement conditions of a temperature increasing rate of 10° C./min and a temperature decreasing rate of 10° C./min. Measured data is obtained during the second heating stage, and then a glass transition point (Tg) is obtained as a value which is read at the intersection of the extension of the base line, prior to the initial rise of the first endothermic peak, with the tangent showing the maximum inclination between the initial rise of the first endothermic peak and the peak summit. Incidentally, during the first temperature increase, temperature is kept at 200° C. for 5 minutes.

Further, the softening temperature is determined as follows: namely, at first, 1.1 g of the aromatic diol-containing polyester is placed in a petri dish at ambiences of 20° C. and 50% RH, followed by being made even and by being allowed to stand for at least 12 hours, and thereafter a pressed sample of a 1 cm diameter columnar shape is prepared via compression at a compression pressure of 3820 kg/cm$^2$ for 30 seconds using press instrument "SSP-10A" (produced by shimadzu Corp.). Subsequently, using flow tester "CFT-500D" (produced by Shimadzu Corp.) at ambiences of 24° C. and 50% RH, the pressed sample is extruded through the columnar die orifice (1 mm diameter×1 mm) by use of a 1 cm diameter piston, starting at the time of the termination of preheating, under conditions of a weight of 196 N (20 kgf), an initial temperature of 60° C., preheating duration of 300 seconds, and a temperature increasing rate of 6° C./min. An offset method temperature $T_{offset}$, measured at an offset value of 5 mm via the melt temperature measurement method, being a temperature increasing method, is designated as the softening temperature.

The number average molecular weight (Mn) of such an aromatic diol-containing polyester is preferably from 2,000-10,000, more preferably from 2,500-8,000, and the weight average molecular weight (Mw) thereof is preferably from 3,000-100,000, more preferably from 4,000-70,000, which are determined for a THF soluble part via gel permeation chromatography.

Molecular determination via GPC is carried out as follows: namely, using apparatus "HLC-8220" (produced by Tosoh Corp.) and column "TSK guard column+TSK gel Super HZM-M (three in series)" (produced by Tosoh Corp.), as the column temperature is kept at 40° C., tetrahydrofuran (THF) as a carrier solvent is passed at a flow rate of 0.2 ml/min, and a measurement sample is dissolved in tetrahydrofuran so as for the concentration thereof to be 1 mg/ml under a condition in that dissolution is carried out using an ultrasonic dispersing device at room temperature for 5 minutes. Then a sample solution is obtained via treatment of a membrane filter of a 0.2 μm pore size, and 10 μl thereof is injected into the above apparatus along with the carrier solvent for detection using a refractive index detector (RI detector). Subsequently, the molecular weight of the measurement sample is calculated using a calibration curve wherein the molecular weight distribution of the sample is determined employing a monodispersed polystyrene standard particle. As the standard polystyrene sample used to obtain the calibration curve, there are employed any of those featuring a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, or $4.48\times10^6$. The calibration curve is drawn by connecting at least 10 points obtained via measurement using the standard polystyrene sample. Further, as a detector, the reflective index detector is utilized.

(Crystalline Polyester)

The urea-modified polyester resin according to the toner of the present invention may be formed by containing a crystalline polyester along with an aromatic diol-containing polyester.

Herein, the crystalline polyester is one, featuring a melting point (Tm) in a specific temperature range, which is prepared via polycondensation of an aliphatic diol (OH—$R^1$—OH) and an aliphatic dicarboxylic acid (HOOC—$R^2$—COOH), and the crystalline polyester has a simple structure and exhibits high crystalline properties and sharp melting properties.

The hydrocarbon group $R^1$ constituting the aliphatic diol and the hydrocarbon group $R^2$ constituting the aliphatic dicarboxylic acid each are a chain or cyclic hydrocarbon group which may have a branch with 2-12 carbons, and an ether group may be contained in the hydrocarbon groups.

The crystalline polyester is preferably utilized as a polyester to form the central portion-forming particle, as detailed below.

When the crystalline polyester is utilized in combination, the ratio of the crystalline polyester is preferably at most 48% by weight based on the entire urea-modified polyester resin, more preferably at most 30% by weight.

Further, when the crystalline polyester is utilized as the polyester to form the central portion-forming particle, the ratio thereof is preferably at most 48% by weight based on the entire polyester to form the central portion-forming particle, more preferably at most 30% by weight.

The specific temperature range of the melting point (Tm) of the crystalline polyester is preferably from 30-99° C., more preferably from 45-88° C.

Herein, the melting point (Tm) of the crystalline polyester, referring to the temperature of the peak maximum of endothermic peaks, DSC-determined via differential scanning calorimetry using differential scanning calorimeter "DSC-7" (produced by Perkin Elmer, Inc.) and thermal analyzer controller "TAC7/DX" (produced by Perkin Elmer, Inc.).

Specifically, 4.5 mg of the crystalline polyester is sealed in an aluminum pan (Kit No. 0219-0041) and placed in a "DSC-7" sample holder. Subsequently, heating-cooling-heating temperature control is carried out over a measurement temperature range of 0-200° C. under measurement conditions of a temperature increasing rate of 10° C./min and a temperature decreasing rate of 10° C./min. Analysis is performed based on data obtained during the second heating stage. Herein, an empty aluminum pan is used as the reference measurement.

The number average molecular weight (Mn) of the crystalline polyester is preferably from 100-10,000, more preferably from 800-5,000, and the weight average molecular weight (Mw) thereof is preferably from 1,000-50,000, more preferably from 2,000-30,000, which are determined for a tetrahydrofuran (THF) soluble part via gel permeation chromatography.

Herein, the molecular weight of the crystalline polyester is determined for a measurement sample prepared from the crystalline polyester in the same manner as described above.

Preferable examples of such a crystalline polyester include polyalkylene polyesters.

Specifically, there are exemplified polyethylene sebacate, polyethylene adipate, polyhexamethylene sebacate, polyoctamethylene dodecanedioate, polyhexamethylene-decamethylene-sebacate and polyoxydecamethylene-2-methyl-1,3-propane-dodecanedioate.

These may be used individually or in combination.

Examples of the aliphatic diol to form the crystalline polyester include, for example, ethylene glycol, diethylene glycol, triethylene glycol, 1,2-propylene glycol, 1,3-propylene glycol, 1,4-butanediol, 1,4-butenediol, neopentylglycol, 1,5-pentane glycol, 1,6-hexane glycol, 1,7-heptane glycol, 1,8-octanediol, 1,9-nonanediol, 1,10-decanediol, 1,4-cyclohexanediol, dipropylene glycol, and hexamethylene glycol. These may be used individually or in combination.

To adjust the melting point, in addition to these aliphatic diols, the crystalline polyester may be polymerized with a minute amount of an aliphatic polyol of at least trivalent such as glycerin, trimethylolethane, trimethylolpropane, pentaerythritol, sorbitol, trisphenol PA, phenol novolac, cresol novolac, or alkylene oxide adducts thereof.

The used ratio of the aliphatic polyol of at least trivalent is preferably from 1-40% by weight, more preferably from 2-30% by weight based on the total amount including the aliphatic diol used. When the used ratio of the aliphatic polyol is less than 1% by weight based on the total amount including the aliphatic diol used, no adequate effect of adjusting the melting point may be produced. In contrast, when the used ratio of the aliphatic polyol exceeds 30% by weight based on the total amount including the aliphatic diol used, a polyester formed tends not to be crystalline.

Further, examples of the aliphatic dicarboxylic acid to form the crystalline polyester include oxalic acid, malonic acid, succinic acid, glutaric acid, adipic acid, suberic acid, azelaic acid, sebacic acid, pimelic acid, citraconic acid, maleic acid, fumaric acid, itaconic acid, glutaconic acid, iso-dodecylsuccinic acid, iso-dodecenylsuccinic acid, n-dodecylsuccinic acid, n-dodecenylsuccinic acid, n-octylsuccinic acid, and n-octenylsuccinic acid, and acid anhydrides thereof or acid chlorides thereof. These may be utilized individually or in combination.

To adjust the melting point, in addition to these aliphatic dicarboxylic acids, the crystalline polyester may be polymerized with a minute amount of a polyvalent carboxylic acid such as trimellitic acid, pyromellitic acid, acid anhydrides thereof, or acid chlorides thereof.

The used ratio of the polyvalent carboxylic acid of at least trivalent is preferably from 0.1-30% by weight, more preferably from 0.2-5% by weight based on the total amount including the aliphatic dicarboxylic acid used. When the used ratio of the polyvalent carboxylic acid is less than 1% by weight based on the total amount including the aliphatic dicarboxylic acid used, no adequate effect of adjusting the melting point may be produced. In contrast, when the used ratio of the polyvalent carboxylic acid exceeds 30% by weight based on the total amount including the aliphatic dicarboxylic acid used, a polyester formed tends not to be crystalline.

With regard to the used ratio of the aliphatic diol to the aliphatic dicarboxylic acid to synthesize the crystalline polyester, the equivalent ratio (OH)/(COOH) of a hydroxyl group (OH) of the aliphatic diol to a carboxyl group (COOH) of the aliphatic dicarboxylic acid is preferably from 1.5/1-1/1.5, more preferably from 1.2/1-1/1.2.

When the used ratio of the aliphatic diol to the aliphatic dicarboxylic acid falls within the above ranges, the crystalline polyester featuring the desired molecular weight can be certainly obtained.

A polyvalent isocyanate compound that isocyanate-modifies the crystalline polyester includes those similar to the polyvalent isocyanate compound used to isocyanate-modify the aromatic diol-containing polyester described above.

A polyamine used to urea-bond an isocyanate-modified aromatic diol-containing polyester and an isocyanate-modified crystalline polyester is exemplified by a diamine including an aromatic diamine such as phenylenediamine, diethyltoluenediamine, or 4,4'-diaminodiphenylmethane, an alicyclic diamine such as 4,4'-diamino-3,3'-dimethyldicyclohexylmethane, diaminecyclohexane, or isopholonediamine, and an aliphatic diamine such as ethylenediamine, tetramethylenediamine, or hexamethylenediamine; a polyamine of at least trivalent such as diethylenetriamine or triethylenetetramine; an amino alcohol such as ethanolamine or hydroxyethylaniline; an aminomercaptane such as aminoethylmercaptane or aminopropylmercaptane; an amino acid such as aminopropionic acid or aminocapronic acid; and an amino-blocked compound such as a ketoimine compound or an oxazolizone compound formed by blocking the amino group of the above amino acid via reaction with a ketone such as acetone, methyl ethyl ketone, or methyl isobutyl ketone. These may be utilized individually or in combination.

In the present invention, a diamine is preferably utilized as the polyamine, but a mixture of the diamine and a small amount of a polyamine of at least trivalent may be utilized to enable melt viscosity of a urea-modified polyester resin to be appropriate. The reason is that a remaining unreacted amino terminal may bring about the possibility that a toner tends not to be charged in high uniformity.

The weight average molecular weight (Mw) of the above urea-modified polyester resin is preferably from 5,000-500,000, more preferably from 10,000-100,000. The number average molecular weight (Mn) thereof is also preferably from 3,500-400,000, more preferably from 7,000-80,000. When the molecular weight of the urea-modified polyester resin falls within the ranges, the urea modification makes it possible that the toner exhibits adequate low-temperature fixability and excellent adhesion to a recording material, as well as crushing resistance of toner particles in the developing device, and also a final fixed image exhibits high strength.

Although adequate low-temperature fixability is realized due to low melt viscosity in cases when the molecular weight of the urea-modified polyester resin is too low, in this case, since the strength of toner particles on their own are slightly low, the toner particles may be crushed via stress in the developing device and the strength of a final fixed image tends to be low. Further, when the molecular weight of the urea-modified polyester resin is too high, no adequate adhesion to a recording material may be realized due to its high melt viscosity.

Herein, the molecular weight of the urea-modified polyester resin is determined using the toner as a measurement sample in the same manner as described above.

Further, the acid value of the urea-modified polyester resin is preferably from 5-45 mg KOH/g, more preferably from 5-30 mg KOH/g. When the acid value of the urea-modified polyester resin is too high, a fixed image may be degraded since being subject to ambience in cases when an image forming process is carried out under a high-temperature and humidity ambience or under a low-temperature and humidity.

Additionally, the glass transition temperature (Tg) of the urea-modified polyester resin is preferably from 30-60° C., more preferably from 35-54° C., and the softening temperature thereof is preferably from 70-120° C., more preferably from 80-110° C.

Herein, the glass transition temperature (Tg) and the softening temperature of the urea-modified polyester resin are determined using the toner as a measurement sample in the same manner as described above.

(Colorant)

A colorant constituting the toner of the present invention is not specifically limited, but any of a carbon black, magnetic material, dye, and pigment may be utilized. Examples of a carbon black include channel black, furnace black, acetylene black, thermal black, or lamp black. It is possible to utilize, as a magnetic material, ferromagnetic metals such as iron, nickel, or cobalt; alloys containing these metals; ferromagnetic metal compounds such as ferrite or magnetite; alloys, which contains no ferromagnetic metals, capable of exhibiting ferromagnetism via heat treatment, such as Heusler alloys, for example, manganese-copper-aluminum, or manganese-copper-tin; and chromium dioxide.

It is possible to utilize, as a dye, C.I. Solvent Red 1, C.I. Solvent Red 49, C.I. Solvent Red 52, C.I. Solvent Red 58, C.I. Solvent Red 63, C.I. Solvent Red 111, C.I. Solvent Red 122, C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. Solvent Yellow 162, C.I. Solvent Blue 25, C.I. Solvent Blue 36, C.I. Solvent Blue 60, C.I. Solvent Blue 70, C.I. Solvent Blue 93, and C.I. Solvent Blue 95, further including mixtures thereof. It is possible to utilize, as a pigment, C.I. Pigment Red 5, C.I. Pigment Red 48:1, C.I. Pigment Red 53:1, C.I. Pigment Red 57:1, C.I. Pigment Red 122, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, C.I. Pigment Orange 31, C.I. Pigment Orange 43, C.I. Pigment Yellow 14, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 180, C.I. Pigment Yellow 185, C.I. Pigment Green 7, C.I. Pigment Blue 15:3, and C.I. Pigment Blue 60, further including mixtures thereof.

(Production Method of Toner)

The toner of the present invention may be prepared via application of molecular growth of a particle in an aqueous medium. Specifically, as the urea-modified polyester resin constituting the central portion (namely the core) of a toner particle, fine particles containing a low content aromatic diol-containing polyester are aggregated in an aqueous medium, and a high content aromatic diol-containing polyester dissolved in a solvent is added to the resultant central portion-forming particles in the above aqueous medium in the form of an oil droplet, and then is absorbed to the central portion-forming particles. Herein, either of the low content aromatic diol-containing polyester forming the central portion and the high content aromatic diol-containing polyester forming the surface-portion has a reactive substituent such as an isocyanate group. By making an amine cross-linking agent coexist to allow both of the polyesters to react during the absorption, the toner can be produced via a method of localizing the high content aromatic diol-containing polyester near the surface via molecular expansion reaction.

The amine cross-linking agent may be added in the reaction system along with either the low content aromatic diol-containing polyester or the high content aromatic diol-containing polyester.

As a production method of such a toner, the following production methods (I)-(IV) are exemplified.

Production Method (I):

(1) a synthesis process of a polyester, wherein a low content aromatic diol-containing polyester a is synthesized, (2) a preparation process of a polyester dispersion, wherein oil droplets are formed in an aqueous medium using a polyester composition a1, composed of the low content aromatic diol-containing polyester a, a colorant, and a solvent, (3) an aggregation process of a central portion-forming particle, wherein the oil droplets in the polyester dispersion obtained in (2) described above are aggregated, (4-1) a synthesis process of a polyester, wherein a high content aromatic diol-containing polyester b is synthesized, (4-2) an isocyanate modification process, wherein an isocyanate-modified high content aromatic diol-containing polyester B is obtained by isocyanate-modifying the high content aromatic diol-containing polyester b, (5) an addition process of an isocyanate-modified polyester, wherein a polyester composition B1, composed of the isocyanate-modified high content aromatic diol-containing polyester B, an amine cross-linking agent, and a solvent, are mixed, and then added in the above aqueous medium, (6) a formation process of the surface-portion, wherein a colored particle is obtained by forming the surface-portion, incorporating the isocyanate-modified high content aromatic diol-containing polyester B, on the surface of the central portion-forming particle obtained in the process (3), (7) a filtration•washing process, wherein the colored particle obtained is filtered out of the aqueous medium and washed to remove substances such as a surfactant from the colored particle, (8) a drying process of the washed colored particle, and (9) an addition process of an external additive, wherein a toner particle is obtained by adding an external additive to the dried colored particle.

Production Method (II):

(1) a synthesis process of a polyester, wherein a low content aromatic diol-containing polyester a is synthesized, (2) a preparation process of a polyester dispersion, wherein oil droplets are formed in an aqueous medium using a polyester composition a2, composed of the low content aromatic diol-containing polyester a, a colorant, an amine cross-linking agent and a solvent, (3) an aggregation process of a central portion-forming particle, wherein the oil droplets in the polyester dispersion obtained in (2) described above are aggregated, (4-1) a synthesis process of a polyester, wherein a high content aromatic diol-containing polyester b is synthesized, (4-2) an isocyanate modification process, wherein an isocyanate-modified high content aromatic diol-containing polyester B is obtained by isocyanate-modifying the high content aromatic diol-containing polyester b, (5) an addition process of an isocyanate-modified polyester, wherein a polyester composition B2, composed of the isocyanate-modified high content aromatic diol-containing polyester B and a solvent, are mixed, and then added in the above aqueous medium, (6) a formation process of the surface-portion, wherein a colored particle is obtained by forming the surface-portion, incorporating the isocyanate-modified high content aromatic diol-containing polyester B, on the surface of the central portion-forming particle obtained in the process (3), (7) a filtration•washing process, wherein the colored particle obtained is filtered out of the aqueous medium and washed to remove substances such as a surfactant from the colored particle, (8) a drying process of the washed colored particle, and (9) an external additive addition process, wherein a toner particle is obtained by adding an external additive to the dried colored particle.

Production Method (III):

(1-1) a synthesis process of a polyester, wherein a low content aromatic diol-containing polyester a is synthesized, (1-2) an isocyanate modification process, wherein an isocyanate-modified low content aromatic diol-containing polyester A is obtained by isocyanate-modifying the low content aromatic diol-containing polyester a, (2) a preparation process of an isocyanate-modified polyester dispersion, wherein oil droplets are formed in an aqueous medium using a polyester composition A1, composed of the isocyanate-modified low content aromatic diol-containing polyester A, a colorant, and a solvent, (3) an aggregation process of a central portion-forming particle, wherein the oil droplets in the isocyanate-modified polyester dispersion obtained in (2) described above are aggregated, (4) a synthesis process of a polyester, wherein a high content aromatic diol-containing polyester b is synthesized, (5) an addition process of a polyester, wherein a polyester composition b1, composed of the high content aromatic diol-containing polyester b, an amine cross-linking agent, and a solvent, are mixed, and then added in the above aqueous medium, (6) a formation process of the surface-portion, wherein a colored particle is obtained by forming the surface-portion, incorporating the polyester b, on the surface of the central portion-forming particle obtained in the process (3), (7) a filtration•washing process, wherein the colored particle obtained is filtered out of the aqueous medium and washed to remove substances such as a surfactant from the colored particle, (8) a drying process of the washed colored particle, and (9) an external additive addition process, wherein a toner particle is obtained by adding an external additive to the dried colored particle.

Production Method (IV):

(1-1) a synthesis process of a polyester, wherein a low content aromatic diol-containing polyester a is synthesized, (1-2) an isocyanate modification process, wherein an isocyanate-modified low content aromatic diol-containing polyester A is obtained by isocyanate-modifying the low content aromatic diol-containing polyester a, (2) a preparation process of an isocyanate-modified polyester dispersion, wherein oil droplets are formed in an aqueous medium using a polyester composition A2, composed of the isocyanate-modified low content aromatic diol-containing polyester A, a colorant, an amine cross-linking agent, and a solvent, (3) an aggregation process of a central portion-forming particle, wherein the oil droplets in the isocyanate-modified polyester dispersion obtained in (2) described above are aggregated, (4) a synthesis process of a polyester, wherein a high content aromatic diol-containing polyester b is synthesized, (5) an addition process of a polyester, wherein a polyester composition b2, composed of the high content aromatic diol-containing polyester b and a solvent, are mixed, and then added in the above aqueous medium, (6) a formation process of the surface-portion, wherein a colored particle is obtained by forming the surface-portion, incorporating the high content aromatic diol-containing polyester b, on the surface of the central portion-forming particle obtained in the process (3), (7) a filtration•washing process, wherein the colored particle obtained is filtered out of the aqueous medium and washed to remove substances such as a surfactant from the colored particle, (8) a drying process of the washed colored particle, and (9) an external additive addition process, wherein a toner particle is obtained by adding an external additive to the dried colored particle.

The production method (I) will now be detailed.

(1) Production Process of a Polyester Relevant to the Low Content Aromatic Diol-Containing Polyester In this process, an aromatic diol-containing polyester having at least one of a hydroxyl group and a carboxyl group is prepared, wherein an aromatic diol and a dicarboxylic acid, if necessary, in combination with an aliphatic diol, a polyol, or a polyvalent carboxylic acid are heated at 150-180° C. in the presence of a catalyst such as tetrabutoxytitanate or dibutyltin oxide, and then water generated is distilled off under reduced pressure, as appropriate.

The content of the aromatic diol based on the entire constituent monomer component is specifically at most 50 mol %, more preferably from 45-10 mol %.

(2) Preparation Process of a Polyester Dispersion

This process is one wherein a polyester composition is prepared by dissolving or dispersing toner constituent materials such as a polyester and a colorant, in combination with wax or a charge controller, as appropriate, in an organic solvent, and then the thus prepared polyester composition is added in an aqueous medium, followed by being dispersed to form oil droplets in a state where the particle diameter of a colored particle obtained is controlled to the desired diameter.

Any appropriate catalyst such as dibutyltin laurate or dioctyltin laurate may be added to the polyester composition, as appropriate.

An organic solvent used to prepare the polyester composition is preferably a solvent featuring a low boiling point from the viewpoint of easy removal after colored particle formation, as well as low solubility in water. Specifically examples thereof include methyl acetate, ethyl acetate, methyl ethyl ketone, methyl isobutyl ketone, toluene, and xylene. These may be utilized individually or in combination.

The amount of the organic solvent used is commonly from 100-10,000 parts by mass, preferably from 200-5,000 parts by mass, and more preferably from 200-1,000 parts by mass based on 100 parts by mass of the polyester.

As the wax used as appropriate, being not specifically limited, any appropriate wax known in the art may be utilized, including, for example, a hydrocarbon wax such as low molecular weight polyethylene wax, low molecular weight polypropylene wax, Fischertropsh wax, microcrystalline wax and paraffin wax; and an ester wax such as carnauba wax, pentaerythritol behenate, or behenyl citrate. These may be utilized individually or in combination.

As the charge controller used as appropriate, being not specifically limited, any appropriate charge controller known in the art may be utilized. Specific examples include a nigrosine dye, a metallic salt of naphthenic acid or a higher fatty acid, an alkoxylized amine, a quaternary ammonium compound, an azo metal complex, a metallic salt of salicylic acid and a metal complex thereof.

In the polyester composition, the content of the colorant is, specifically from 1-15% by weight, preferably from 4-10% by weight based on the total amount of the solid materials contained in the polyester composition.

Further, when the polyester composition contains wax, the content of the wax is specifically from 2-20% by weight, preferably from 3-18% by weight based on the total amount of the solid materials contained in the polyester composition. Still further, when the polyester composition contains a charge controller, the content of the charge controller is specifically from 0.1-2.5% by weight, preferably from 0.5-2.0% by weight based on the total amount of the solid materials contained in the polyester composition.

Emulsion dispersion of the polyester composition is carried out via mechanical energy, and a dispersing apparatus for use in the emulsion dispersion, being not specifically limited, including a low-speed shear disperser, a high-speed shear disperser, a friction type disperser, a high-pressure jet type disperser, and an ultrasonic disperser, and specifically, for example, T.K. Homo Mixer (produced by Tokushu Kika Kogyo Co., Ltd.) is cited.

The number average primary particle diameter of the oil droplets in a dispersion state is preferably from 60-1000 nm, more preferably from 80-500 nm.

A number average primary particle diameter of the oil droplets is determined using electrophoretic light scattering photometer "ELS-800" (produced by Otsuka Electronics Co., Ltd.).

Herein, the "aqueous medium" refers to a medium containing water at a content ratio of at least 50% by weight. As a component other than water, a water-soluble organic solvent is utilized, including, for example, methanol, ethanol, isopropanol, butanol, acetone, methyl ethyl ketone, dimethylformamide, methyl cellosolve, and tetrahydrofuran. Of these, there is preferably utilized an alcohol based organic solvent such as methanol, ethanol, isopropanol or butanol which dissolves no resin.

The amount of the aqueous medium used is preferably from 50-2,000 parts by mass, more preferably from 100-1,000 parts by mass based on 100 parts by mass of the polyester composition.

When the amount of the aqueous medium used falls within the above ranges, the polyester composition can be emulsion-dispersed in the aqueous medium into oil droplets of the desired particle diameter.

A dispersion stabilizer is dissolved in the aqueous medium. Further, to enhance dispersion stability of the oil droplets, any appropriate substance such as a surfactant or fine resin particles may be added in the aqueous medium.

Examples of the dispersion stabilizer include an inorganic compound such as tricalcium phosphate, calcium carbonate, titanium oxide, colloidal silica, and hydroxyapatite. Since the dispersion stabilizer needs to be removed from the colored particle obtained, those such as tricalcium phosphate, being acid or alkali soluble, are preferably utilized, and from the viewpoint of environmental protection, those, being enzyme-decomposable, are preferably utilized.

As the surfactant, there are utilized, for example, an anionic surfactant such as an alkylbenzene sulfonate, an α-olefin sulfonate, or a phosphate; an amine salt type such as an alkylamine salt, an aminoalcohol aliphatic acid derivative, a polyamine aliphatic acid derivative, or imidazoline; a quaternary ammonium salt type cationic surfactant such as an alkyltrimethyl ammonium salt, a dialkyldimethyl ammonium salt, an alkyldimethylbenzyl ammonium salt, a pyridinium salt, an alkyl isoquinolinium salt, or benzethonium chloride; a nonionic surfactant such as an aliphatic acid amide derivative or a polyol derivative; and an amphoteric surfactant such as alanine, dodecyldi(aminoethyl)glycine, di(octylaminoethyl)glycine, or N-alkyl-N,N-dimethyl ammonium betaine. An anionic and a cationic surfactant having a fluoroalkyl group may also be utilized.

Further, examples of the fine resin particles used to enhance dispersion stability preferably include those featuring a particle diameter of 0.5-3 μm. Specifically, there are exemplified fine resin particles of polymethylmethacrylate of a 1-3 μm particle diameter, of polystyrene of a 0.5-2 μm particle diameter, and of polystyrene-acrylonitrile of a 1 μm particle diameter.

(3) Aggregation Process of a Central Portion-Forming Particle

This process is one wherein oil droplets in the polyester dispersion are aggregated to give a central portion-forming particle featuring a low content ratio of the aromatic diol-containing polyester segment.

Specifically, aggregation of the oil droplets is initiated by the decrease in dispersion stability of the oil droplets in a dispersion state. Further, a specific method is not particularly limited provided that aggregation of the oil droplets can be initiated, but examples of a method of decreasing the dispersion stability include X: a method of elevating temperature of an aqueous medium containing the oil droplets dispersed and Y: a method of adding a coagulant in the aqueous medium. Of these methods, the method X is preferable due to its convenience. In the method X, temperature for initiating the aggregation of the oil droplets is not specifically limited provided that the temperature can initiate the aggregation of the oil droplets, but the temperature is specifically from 50-98° C., preferably from 60-90° C. Further, particle growth is carried out via continued aggregation of the oil droplets, and the aggregation duration is not specifically limited provided that the duration enables the particle to grow to the desired particle diameter, but the duration is specifically from 1-10 hours, preferably 2-8 hours.

It is preferable that the particle diameter of a central portion-forming particle obtained is specifically a volume-based median diameter of 2.0-7.5 μm.

(4-1) Synthesis Process of a Polyester Relevant to the High Content Aromatic Diol-Containing Polyester This process is carried out in the same manner as in the above (1) a synthesis process of a polyester, except that the content ratio of the aromatic diol in the constituent monomer component is increased.

The content ratio of the aromatic diol based on the entire constituent monomer component is specifically at least 51 mol %, more preferably at least 60 mol %.

(4-2) Isocyanate Modification Process

This process is one wherein an isocyanate-modified polyester is obtained by isocyanate-modifying a polyester.

Specifically, a polyvalent isocyanate compound is allowed to react with a prepared polyester at 40-140° C., and then at least one of a hydroxyl group and a carboxyl group at the molecular terminals of the polyester is substituted with an isocyanate group to give an isocyanate-modified polyester. In the reaction of the polyvalent isocyanate compound, a solvent inactive to the polyvalent isocyanate compound may also be utilized, as appropriate, including a ketone such as acetone, methyl ethyl ketone, or methyl isobutyl ketone; an ester such as ethyl acetate; an amide such as dimethylformamide or dimethylacetoamide; an ether such as tetrahydrofuran; and an aromatic solvent such as toluene or xylene.

(5) Addition Process of an Isocyanate-Modified Polyester

This process is one wherein a polyester composition, composed of the isocyanate-modified polyester, an amine cross-linking agent, and a solvent, are mixed and then added in the aqueous medium described above.

Specifically, oil droplets are formed by emulsion-dispersing the polyester composition in an aqueous medium, provided separately from the aqueous medium used in the above (2), in the same manner as in the above (2), and the isocyanate-modified polyester dispersion prepared is added in the aqueous medium described in the above (2).

(6) Formation Process of the Surface-Portion

This process is one wherein molecular expansion is carried out by forming a urea bond on the surface of the central portion-forming particle, obtained in the process (3), via cross-linking reaction of an isocyanate group of the isocyanate-modified polyester, obtained in the process (4-2), with an amine cross-linking agent; then the surface-portion with a high content ratio of the aromatic diol-containing polyester segment is formed; and therefore is formed a colored particle which contains a colorant and appropriate substances such as wax, as necessary, in the urea-modified polyester resin featuring a specific concentration gradient structure wherein the degree of existence of the aromatic diol-containing polyester segment is higher near the surface than in the central portion. Then, the organic solvent is removed after the cross-linking reaction.

The duration of the cross-linking reaction using the amine cross-linking agent varies depending on the types of the raw material and the amine cross-linking agent used. Specifically, the duration is preferably from 1-24 hours, more preferably from 2-15 hours. Further, the reaction temperature is preferably from 20-100° C., more preferably from 50-98° C.

The removal treatment of the solvent after the cross-linking reaction is carried out via such a process that the entire dispersion in a state, where the colored particle is dispersed in an aqueous medium, is gradually heated in a laminar flow stirring state, followed by being vigorously stirred in a predetermined temperature range to remove the solvent.

Further, when the colored particle is formed using a dispersion stabilizer, the dispersion stabilizer is also removed by mixing with an acid or an alkali added, besides the removal treatment of the organic solvent.

After the cross-linking reaction, shape control treatment is preferably carried out. In the shape control treatment, the colored particle dispersion, obtained in the above (6) a formation process of the surface-portion, is passed through a filter of the degree of microns or stirred with an annular continuous wet-type stirring mill to shape-control the colored particle into a value falling within a predetermined ratio range between the long axis and the short axis thereof.

Specific methods of the shape control treatment of the colored particle include, for example, a method of passing the colored particle through a gap, a filter, or a fine pore and a method of controlling the shape by centrifugalizing the colored particle via high-speed rotation. Further, specific apparatuses of shape-controlling the colored particle include a piston-type high-pressure homogenizer and an in-line screw pump in addition to the above annular continuous wet-type stirring mill.

A toner particle of the desired shape can be realized by controlling factors including the duration of the shape control treatment, the treatment temperature, and the treatment rate.

In this way, the shape control treatment of the colored particle is carried out, and then the colored particle featuring the long/short axis ratio in a predetermined range is produced. Incidentally, the removal treatment of the organic solvent may be carried out after this shape control treatment.

(7) Filtration•Washing Process

In this filtration•washing process, filtration treatment is carried out, wherein the colored particle dispersion obtained in the process (6) is cooled, and the colored particle is isolated via solid-liquid separation from the cooled colored particle dispersion; and then washing treatment is carried out, wherein deposits such as a surfactant are removed from the isolated colored particle (being an accumulated substance of a cake-shape). Specific methods of the solid-liquid separation and washing include a centrifugal separation method, a vacuum filtration method carried out employing a Buchner funnel, and a filtration method carried out employing a filter press, but the filtration methods are not specifically limited.

(8) Drying Process

In this process, drying treatment of the washed colored particle is carried out. Driers used in the drying process include a spray drier, vacuum freeze drier, vacuum drier, stationary tray drier, transportable tray drier, fluid layer drier, rotary type drier, and stirring type drier, but these driers are not specifically limited. Incidentally, the moisture content in the dried colored particle is preferably at most 5% by weight, more preferably at most 2% by weight.

Herein, the measurement of the moisture content in the colored particle is carried out via Karl-Fischer coulometric titration. Specifically, automatic thermal evaporation moisture measuring system "AQS-724" (produced by Hiranuma Sangyo Co., Ltd.) constituted of aquameter "AO-6, AQI-601" (an interface for AQ-6) and thermal evaporation apparatus "LE-24S" is utilized. After standing for 24 hours at ambiences of 20° C. and 50% RH, 0.5 g of the colored particle, precisely weighed, is placed in a 20 ml sample tube and the tube is tightly sealed using a silicone rubber packing coated with Teflon (a trade name) to measure the moisture content present in this sealed ambience via measuring conditions and reagents described below. Further, to calibrate the moisture content present in the sealed ambience, two empty sample tubes are measured simultaneously.

Sample heating temperature: 110° C.

Sample heating duration: 1 minute

Nitrogen gas flow rate: 150 ml/min

Reagents: Counter electrode liquid (cathode liquid): HYDRANAL (a trade name) Coulomat CG-K; generation liquid (anode liquid): HYDRANAL (a trade name) Coulomat AK Further, when an aggregate of the dried colored particles is formed thereamong via weak interparticle attractive force, the aggregate may be pulverized. Herein, mechanical pulverizing apparatuses such as a jet mill, a HENSCHEL mixer, a coffee mill, or a food processor may be utilized for a pulverizing method.

(9) External Additive Addition Process

This external additive addition process is one wherein toner particles are prepared by adding external additives such as a charge controller, various inorganic or organic fine particles, or a lubricant to the dried colored particles in order to improve fluidity and charge properties and to enhance cleaning properties. Various mixers known in the art such as a turbular mixer, a HENSCHEL mixer, a Nautor mixer, and a V-shaped mixer may be exemplified as an apparatus used to add these external additives.

As the inorganic fine particles, inorganic oxide particles such as silica, titania, or alumina are preferably utilized. Further, these inorganic fine particles are preferably subjected to hydrophobic treatment using a silane coupling agent or a titanium-coupling agent.

The addition ratio of these external additives in the toner is commonly from 0.1-5.0% by weight, but is preferably from 0.5-4.0% by weight. Any appropriate external additives may also be utilized in combinations.

(Particle Diameter of Toner Particles)

In the toner of the present invention, the particle diameter of toner particles is preferably a volume-based median diameter of 3-8 μm. The particle diameter of the toner particles can be controlled via the concentration of a coagulant, the addition amount of an organic solvent, or the fusing duration in the aggregation process, as well as via the composition of the polyester resins. When the volume-based median particle diameter is 3-8 μm, there are reduced toner particles featuring high adhesion which adhere to the heating member via flight and cause fixing offset in the fixing process, and further transfer efficiency is enhanced, resulting in enhanced halftone image quality as well as in enhanced fine-line and dot image quality. The particle size distribution of the toner is preferably a CV value of 16-35, more preferably from 18-22.

The CV value is determined by following Equation (x):

$$CV\text{ value }(\%)=((\text{standard deviation})/(\text{arithmetic average particle diameter}))\times 100 \qquad \text{Equation (x)}$$

wherein the arithmetic average particle diameter refers to the average value of the volume-based particle diameter x with regard to 25,000 toner particles and is determined using "Coulter Multisizer III" (produced by Beckman Coulter, Inc.).

The volume-based median particle diameter of the toner is measured and calculated using a device constituted of "Coulter Multisizer III" (produced by Beckman Coulter, Inc.) and a data processing computer system (produced by Beckman Coulter, Inc.) connected thereto.

Specifically, 0.02 g of the toner is added in 20 ml of a surfactant solution (being a surfactant solution prepared, for example, via ten-fold dilution of a neutral detergent containing a surfactant component with purified water to disperse a toner), followed by being wetted and then subjected to ultrasonic dispersion for 1 minute to prepare a toner dispersion. The toner dispersion is injected into a beaker, containing electrolyte solution "ISOTON II" (produced by Beckman Coulter, Inc.), set on the sample stand, using a pipette until the concentration indicated by the measuring apparatus reaches 5-10%. Herein, this concentration range makes it possible to obtain highly reproducible measurement values. Using the measuring apparatus, under conditions of a measured particle count number of 25,000 and an aperture diameter of 50 μm, the frequency is calculated by dividing a measurement range of 1-30 μm into 256 parts, and the particle diameter at a 50 point from the higher side of the volume accumulation ratio (namely the volume $D_{50}$% diameter) is designated as the volume-based median diameter.

(Average Circularity of Toner Particles)

Further, the toner of the present invention preferably features an average circularity of 0.930-1.000, more preferably from 0.950-0.995 from the viewpoint of enhancing transfer efficiency.

When the average circularity is in the range of 0.930-1.000, fixability is enhanced via the high filling density of the toner particles in the toner layer transferred onto a recording material, whereby fixing offset tends not to occur. Further, each of the toner particles tends not to be crushed and therefore the contamination of the frictional charge-providing member is reduced, resulting in stable charge properties of the toner.

The average circularity of toner particles refers to a value determined using "FPIA-2100" (produced by Sysmex Corp.). Specifically, the toner is wetted with an aqueous solution containing a surfactant, followed by being dispersed via ultrasonic dispersion treatment for 1 minute, and thereafter the dispersion of the toner particles is photographed with "FPIA-2100" (produced by Sysmex Corp.) in a measurement condition HPF (high magnitude photographing) mode at an appropriate density of a HPF detection number of 3,000-10,000. The circularity of each of the toner particles is calculated according to Equation (y) described below. Then, the average circularity is calculated by totaling the circularities of the individual toner particles and by dividing the resultant value by the total number of the toner particles. The HPF-detected number in the above range makes it possible to realize reproducibility.

$$\text{Circularity}=((\text{circumference of a circle having the same projective area as a particle image})/(\text{circumference of the projective area of the particle}) \qquad \text{Equation (y)}$$

(Developer)

The toner of the present invention can be preferably utilized in such cases that, for example, the toner is used as a single-component magnetic toner containing a magnetic material; the toner is used as a double-component developer by mixing with a so-called carrier; and the toner is used as a non-magnetic toner on its own.

When the toner of the present invention is utilized as the double-component developer by mixing with the carrier, occurrence of toner filming on the carrier (namely carrier contamination) can be inhibited. In cases of being utilized as the single-component developer, occurrence of toner filming on the triboelectric charging member of the developing device can be inhibited.

As the carrier constituting the double-component developer, there may be utilized magnetic particles composed of materials conventionally known in the art including metals such as iron, ferrite, or magnetite and alloys of the above metals with metals such as aluminum or lead. Specifically, ferrite particles are preferable.

The carrier having a volume average particle diameter of 15-100 μm is preferable, but a more preferable range is from 25-60 μm. It is possible to determine the volume average particle diameter of a carrier using laser diffraction system particle size distribution meter "HELOS" (produced by SYMPATEC Co.).

As the carrier, there is preferably utilized a carrier prepared by further coating with a resin or a so-called resin dispersion type carrier prepared by dispersing magnetic particles in a resin. A resin composition for such coating is not specifically limited. Examples thereof include an olefin based resin, styrene based resin, styrene-acryl based resin, silicone based resin, ester based resin, and fluorine-containing polymer based resin. A resin constituting the resin dispersion type carrier is not also specifically limited, and any of those known in the art may be utilized, including, for example, a styrene-acryl based resin, polyester resin, fluorine based resin, and phenol resin.

(Image Forming Method)

Any one of the above toners can be preferably utilized for an image forming method including a fixing process via a contact heating method. In the image forming method, for example, using any of the toners described above, an electrostatic latent image formed on an image carrier electrostatically is developed by charging a developer with the triboelectric charging member of the developing device to form a toner image, which is transferred onto a recording material. Then, the transferred toner image on the recording material is fixed on the recording material via the fixing treatment employing the contact heating method to form a visible image.

Further, the toners can be preferably utilized in an image forming method of high speed full-color printing at a print rate of at least 30 sheets/min in full-color printing wherein an A4-size recording material is fed laterally.

(Fixing Method)

As a preferable fixing method using the toner of the present invention, a method such as a so-called contact heating method is exemplified. The contact heating method specifically includes a heat pressure fixing method, a heating roller fixing method, and a pressure contact heating fixing method using a rotatable pressing member having a heater fixed therein.

In a fixing method employing the heating roller fixing method, a fixing device is commonly utilized which is constituted of a top roller (namely the fixing roller) provided with a heat source in the cylinder made of metal such as iron or aluminum coated with a resin such as a fluorine resin as well as a bottom roller made of, for example, silicone rubber. A line-shaped heater is utilized as the heat source that heats the surface of the top roller up to a surface temperature of 120-200° C. approximately. Pressure is applied between the top roller and the bottom roller, and then with this pressure, the bottom roller is deformed, resulting in formation of a so-called nip at the deformed portion. The width of the nip is from 1-10 mm, preferably from 1.5-7 mm. The fixing line speed is preferably from 40 mm/sec-600 mm/sec. When the nip width is too small, heat tends not to be uniformly applied to the toner, whereby fixation unevenness may occur. In contrast, when the nip width is too large, the melting of the polyester resin contained in the toner particle is promoted, whereby fixing offset may occur.

According to the toner as described above, since a polyester resin constituting the binder rein features a specific concentration gradient structure wherein the degree of existence of the aromatic diol-containing polyester segment contained in the polyester resin is higher near the surface than in the central portion of the toner particle, the polyester resin, featuring relatively low melt viscosity, which constitutes the central portion makes it possible that the toner particle exhibits adequate low-temperature fixability as a whole.

Further, a polyester resin, featuring an amorphous structure, which contains the aromatic diol-containing polyester segment, differs from a so-called crystalline polyester, whereby the polyester resin has no characteristic in that its melt viscosity rapidly decreases at high temperatures, and then no high-temperature offset phenomena occur due to a certain level of melt viscosity retained even in the melt state, resulting in adequate fixing separation properties enabling enhanced high-speed fixability. In addition, the toner does not feature, for example, a core-shell structure simply having an amorphous structural polyester near the surface of the toner particle, but features a specific concentration gradient structure, whereby adequate low-temperature fixability and enhanced heat-resistant storage properties can be realized with very limited occurrence of high-temperature offset phenomena.

The embodiments of the present invention have been described above, but the present invention is not limited thereto, and various changes may be added.

EXAMPLES

Examples conducted to confirm the effect of the present invention will now be described below, but the present invention is not limited thereto.

(Synthesis Example of High Content Aromatic Diol-Containing Polyester [b])

A reaction vessel fitted with a stirrer and a nitrogen introducing tube was charged with 724 parts by mass of 2 mole-ethylene oxide adduct of bisphenol A, 200 parts by mass of isophthalic acid, 70 parts by mass of fumaric acid, and 2 parts by mass of dibutyltin oxide, which were allowed to react at 230° C. for 4 hours at ordinary pressure, followed by reacting under a reduced pressure of 12 mmHg for 4 hours and then by being cooled to 160° C. Subsequently, 32 parts by mass of phthalic anhydride was added, followed by reacting for 2 hours to give high content aromatic diol-containing polyester [b]. The glass transition temperature (Tg) of this high content aromatic diol-containing polyester [b] was 48° C. and the softening temperature thereof was 102° C. The number average molecular weight (Mn) was 3,200 and the weight average molecular weight (Mw) was 18,000.

(Synthesis Example of an Isocyanate-Modified High Content Aromatic Diol-Containing Polyester [B])

To 1,000 parts by mass of high content aromatic diol-containing polyester [b], 2,000 parts by mass of ethyl acetate was added, followed by addition of 120 parts by mass of isophorone diisocyanate to allow the resultant mixture to react at 80° C. for 2 hours, and then an isocyanate-modified high content aromatic diol-containing polyester [B] was obtained.

(Synthesis Example of Low Content Aromatic Diol-Containing Polyester [a])

A reaction vessel fitted with a stirrer and a nitrogen introducing tube was charged with 250 parts by mass of 2 mole-ethylene oxide adduct of bisphenol A, 53 parts by mass of ethylene glycol, 200 parts by mass of isophthalic acid, 70 parts by mass of fumaric acid, and 2 parts by mass of dibutyltin oxide, which were allowed to react at 230° C. for 5 hours at ordinary pressure, followed by reacting under a reduced pressure of 12 mmHg for 4 hours and then by being cooled to 160° C. Subsequently, 32 parts by mass of phthalic anhydride was added, followed by reacting for 2 hours to give low content aromatic diol-containing polyester [a]. The glass transition temperature (Tg) of this low content aromatic diol-containing polyester [a] was 47° C. and the softening temperature thereof was 106° C. The number average molecular weight (Mn) was 4,000 and the weight average molecular weight (Mw) was 29,000.

(Synthesis Example of Isocyanate-Modified Low Content Aromatic Diol-Containing Polyester [A])

To 1,000 parts by mass of low content aromatic diol-containing polyester [a], 2,000 parts by mass of ethyl acetate was added, followed by addition of 130 parts by mass of isophorone diisocyanate to allow the resultant mixture to react at 80° C. for 2 hours, and then an isocyanate-modified low content aromatic diol-containing polyester [a] was obtained.

Toner Production Example Bk1

Production Method (I)

In a mixing vessel equipped with a reflux condenser and a stirrer, 900 parts by mass of ethylacetate, 300 parts by mass of low content aromatic diol-containing polyester [a], 4 parts by mass of copper phthalocyanine blue, 4 parts by mass of carbon black and 15 parts by mass of pentaerythritoltetrastearate were charged and mixed for 2 hours at a mixing temperature of 20° C. to obtain low content aromatic diol-containing polyester composition [a1].

In another reaction vessel, 600 parts by mass of deionized water, 60 parts by mass of methyl ethyl ketone, 60 parts by mass of tricalcium phosphate, and 0.3 part by mass of sodium dodecylbenzenesulfonate were charged. While the mixture was stirred at 30° C. for 3 minutes using a TK type homomixer (produced by a Tokushu Kika Kogyo Co., Ltd.) at 15,000 rpm, the abovementioned low content aromatic diol-containing polyester composition [a1] was added to form oil droplets having a number average primary particle diameter of 0.5 μm dispersed in an aqueous medium. After that, the stirrer was changed to a usual stirrer and the temperature of the product was raised to 80° C. while stirring at 300 rpm, followed by stirring for 3 hours to aggregate particles. Thus, central portion-forming particles having a volume median diameter of 6.8 μm were obtained.

Further, in another stirring vessel, a mixed solution of 500 parts by mass of ethylacetate, 300 parts by mass of isocyanate-modified high content aromatic diol-containing polyester [B] and 10 parts by mass of isophorone diamine was prepared, and the mixed solution was dispersed in an aqueous medium containing 600 parts by mass of deionized water, 60 parts by mass of methyl ethyl ketone, 60 parts by mass of tricalcium phosphate and 0.3 part by mass of sodium dodecylbenzenesulfonate, using a TK type homomixer (produced by a Tokushu Kika Kogyo Co., Ltd.) at 15.00 rpm for 2 minutes at a temperature of 30° C. to form oil droplets having a number average primary particle diameter of 0.5 μm. Thus, isocyanate-modified high content aromatic diol-containing polyester dispersion [B1] was obtained.

The abovementioned liquid containing the central portion-forming particles was transferred to another stirring vessel and 0.3 part by mass of sodium dodecylsulfate was added at 30° C. After that, the above isocyanate-modified high content aromatic diol-containing polyester dispersion [B1] was added, the temperature was raised to 75° C. and molecule elongation was carried out for 8 hours, followed by raising the temperature to 95° C. to remove ethyl acetate. After ethyl acetate was fully removed, the liquid was cooled to ambient temperature and 150 parts by mass of 35% concentrated hydrochloric acid was added to dissolve out tricalcium phosphate on the toner surface. Subsequently, after repeating the process in which solid component was separated from the liquid, the obtained toner cake was dehydrated and the dehydrated toner cake was reslurried in deionized water by three timed, the toner was dried for 24 hours at 40° C. to obtain colored particles [Bk1] in which the content of the aromatic diol-containing polyester is higher in the surface portion than in the central portion of each particle.

To 100 parts by mass of obtained colored particle [Bk1], 0.6 part by mass of silica and 1.0 part by mass of hydrophobic titanium oxides were mixed using a Henschel mixer to obtain toner [Bk1]. The mixing was carried out for 20 minutes at 32° C. with the rotary-wing rotor circumferential speed of the Henschel mixer of 35 m/sec, and the toner was passed through a sieve of 45 micrometers of openings pass.

The volume median diameter of toner [Bk1] was 5.9 μm, the average circularity was 0.968, the glass transition temperature (Tg) was 53° C., the softening temperature was 109° C., the number average molecular weight (Mn) was 11,500, the weight average molecular weight was (Mw) was 69,000 and the CV value was 18.

Toner Production Example Y1

Toner [Y1] was prepared in the same manner as toner production example Bk1 except that 8 parts by mass of Pigment Yellow 74 was used instead of 4 parts by mass of copper phthalocyanine blue and 4 parts by mass of carbon black.

The volume median diameter of toner [Y1] was 5.9 μm, the average circularity was 0.969, the glass transition temperature (Tg) was 53° C., the softening temperature was 109° C., the number average molecular weight (Mn) was 11,500, the weight average molecular weight was (Mw) was 69,000 and the CV value was 18.

Toner Production Example M1

Toner [M1] was prepared in the same manner as toner production example Bk1 except that 8 parts by mass of Pigment Red 122 was used instead of 4 parts by mass of copper phthalocyanine blue and 4 parts by mass of carbon black.

The volume median diameter of toner [M1] was 5.9 μm, the average circularity was 0.969, the glass transition temperature (Tg) was 53° C., the softening temperature was 109° C., the number average molecular weight (Mn) was 11,500, the weight average molecular weight was (Mw) was 69,000 and the CV value was 18.

Toner Production Example C1

Toner [C1] was prepared in the same manner as toner production example Bk1 except that 8 parts by mass of copper phthalocyanine blue was used instead of 4 parts by mass of copper phthalocyanine blue and 4 parts by mass of carbon black.

The volume median diameter of toner [C1] was 5.9 μm, the average circularity was 0.971, the glass transition temperature (Tg) was 53° C., the softening temperature was 109° C., the number average molecular weight (Mn) was 11,800, the weight average molecular weight was (Mw) was 69,100 and the CV value was 18.

Toner Production Example Bk2

Production Method (II)

In a mixing vessel equipped with a reflux condenser and a stirrer, 900 parts by mass of ethylacetate, 300 parts by mass of low content aromatic diol-containing polyester [a], 15 parts by mass of a ketimine compound derived from methyl ethyl ketone and hexamethylenediamine, 4 parts by mass of copper phthalocyanine blue, 4 parts by mass of carbon black and 15 parts by mass of pentaerythritoltetrastearate were charged and mixed for 2 hours at a mixing temperature of 20° C. to obtain low content aromatic diol-containing polyester composition [a2].

In another reaction vessel, 600 parts by mass of deionized water, 60 parts by mass of methyl ethyl ketone, 60 parts by mass of tricalcium phosphate, and 0.3 part by mass of sodium dodecylbenzenesulfonate were charged. While the mixture was stirred at 30° C. for 3 minutes using a TK type homomixer (produced by a Tokushu Kika Kogyo Co., Ltd.) at 15,000 rpm, the abovementioned low content aromatic diol-containing polyester composition [a2] was added to form oil droplets having a number average primary particle diameter of 0.5 μm dispersed in an aqueous medium. After that, the stirrer was changed to a usual stirrer and the temperature of the product was raised to 80° C. while stirring at 300 rpm, followed by stirring for 3 hours to aggregate particles. Thus, central portion-forming particles having a volume median diameter of 6.8 μm were obtained.

Further, in another stirring vessel, a mixed solution of 500 parts by mass of ethylacetate and 300 parts by mass of isocyanate-modified high content aromatic diol-containing polyester [B] was prepared, and the mixed solution was dispersed in an aqueous medium containing 600 parts by mass of deionized water, 60 parts by mass of methyl ethyl ketone, 60 parts by mass of tricalcium phosphate and 0.3 part by mass of sodium dodecylbenzenesulfonate, using a TK type homomixer (produced by a Tokushu Kika Kogyo Co., Ltd.) at 15.00 rpm for 2 minutes at a temperature of 30° C. to form oil droplets having a number average primary particle diameter of 0.5 μm. Thus, isocyanate-modified high content aromatic diol-containing polyester dispersion [B2] was obtained.

The abovementioned liquid containing the central portion-forming particles was transferred to another stirring vessel and 0.3 part by mass of sodium dodecylsulfate was added at 30° C. After that, the above isocyanate-modified high content aromatic diol-containing polyester dispersion [B2] was added, the temperature was raised to 75° C. and molecule elongation was carried out for 8 hours, followed by raising the temperature to 95° C. to remove ethyl acetate. After ethyl acetate was fully removed, the liquid was cooled to an ambient temperature and 150 parts by mass of 35% concentrated hydrochloric acid was added to dissolve out tricalcium phosphate on the toner surface. Subsequently, after repeating the process in which solid component was separated from the liquid, the obtained toner cake was dehydrated and then the dehydrated toner cake was reslurried in deionized water, by three timed, the toner was dried for 24 hours at 40° C. to obtain colored particles [Bk2] in which the content of the aromatic diol-containing polyester segment is higher in the surface portion than in the central portion of each particle.

To 100 parts by mass of obtained colored particle [Bk2], 0.6 part by mass of silica and 1.0 part by mass of hydrophobic titanium oxides were mixed using a Henschel mixer to obtain toner [Bk2]. The mixing was carried out for 20 minutes at 32° C. with the rotary-wing rotor circumferential speed of the Henschel mixer of 35 m/sec, and the toner was passed through a sieve of 45 micrometers of openings pass.

The volume median diameter of toner [Bk2] was 6.1 μm, the average circularity was 0.971, the glass transition temperature (Tg) was 51° C., the softening temperature was 103° C., the number average molecular weight (Mn) was 10,500, the weight average molecular weight was (Mw) was 67,000 and the CV value was 19.

Toner Production Example Y2

Toner [Y2] was prepared in the same manner as toner production example Bk2 except that 8 parts by mass of Pigment Yellow 74 was used instead of 4 parts by mass of copper phthalocyanine blue and 4 parts by mass of carbon black.

The volume median diameter of toner [Y2] was 5.7 μm, the average circularity was 0.970, the glass transition temperature (Tg) was 51° C., the softening temperature was 103° C., the number average molecular weight (Mn) was 10,500, the weight average molecular weight was (Mw) was 69,000 and the CV value was 18.

Toner Production Example M2

Toner [M2] was prepared in the same manner as toner production example Bk2 except that 8 parts by mass of Pigment Red 122 was used instead of 4 parts by mass of copper phthalocyanine blue and 4 parts by mass of carbon black.

The volume median diameter of toner [M2] was 5.9 μm, the average circularity was 0.969, the glass transition temperature (Tg) was 51° C., the softening temperature was 103° C., the number average molecular weight (Mn) was 11,500, the weight average molecular weight was (Mw) was 69,000 and the CV value was 18.

Toner Production Example C2

Toner [C2] was prepared in the same manner as toner production example Bk2 except that 8 parts by mass of copper phthalocyanine blue was used instead of 4 parts by mass of copper phthalocyanine blue and 4 parts by mass of carbon black.

The volume median diameter of toner [C2] was 5.9 μm, the average circularity was 0.971, the glass transition temperature (Tg) was 51° C., the softening temperature was 103° C., the number average molecular weight (Mn) was 11,400, the weight average molecular weight was (Mw) was 69,000 and the CV value was 18.

Toner Production Example Bk3

Production Method (III)

In a mixing vessel equipped with a reflux condenser and a stirrer, 900 parts by mass of ethylacetate, 300 parts by mass of isocyanate-modified low content aromatic diol-containing polyester [A], 4 parts by mass of copper phthalocyanine blue, 4 parts by mass of carbon black and 15 parts by mass of pentaerythritoltetrastearate were charged and mixed for 2 hours at a mixing temperature of 20° C. to obtain isocyanate-modified low content aromatic diol-containing polyester composition [A1].

In another reaction vessel, 600 parts by mass of deionized water, 60 parts by mass of methyl ethyl ketone, 60 parts by mass of tricalcium phosphate, and 0.3 part by mass of sodium dodecylbenzenesulfonate were charged. While the mixture was stirred at 30° C. for 3 minutes using a TK type homomixer (produced by a Tokushu Kika Kogyo Co., Ltd.) at 15,000 rpm, the abovementioned isocyanate-modified low content aromatic diol-containing polyester composition [A1] was added to form oil droplets having a number average primary particle diameter of 0.5 μm dispersed in an aqueous medium. After that, the stirrer was changed to a usual stirrer and the temperature of the product was raised to 80° C. while stirring at 300 rpm, followed by stirring for 3 hours to aggregate particles. Thus, central portion-forming particles having a volume median diameter of 6.8 μm were obtained.

Further, in another stirring vessel, a mixed solution of 500 parts by mass of ethylacetate, 300 parts by mass of high content aromatic diol-containing polyester [b] and 15 parts by mass of a ketimine compound derived from methyl ethyl ketone and hexamethylenediamine, and the mixed solution was dispersed in an aqueous medium containing 600 parts by mass of deionized water, 60 parts by mass of methyl ethyl ketone, 60 parts by mass of tricalcium phosphate and 0.3 part by mass of sodium dodecylbenzenesulfonate, using a TK type homomixer (produced by a Tokushu Kika Kogyo Co., Ltd.) at 15.00 rpm for 2 minutes at a temperature of 30° C. to form oil droplets having a number average primary particle diameter of 0.5 μm. Thus, high content aromatic diol-containing polyester dispersion [b1] was obtained.

The abovementioned liquid containing the central portion-forming particles was transferred to another stirring vessel and 0.3 part by mass of sodium dodecylsulfate was added at 30° C. After that, the above high content aromatic diol-containing polyester dispersion [b1] was added, the temperature was raised to 75° C. and molecule elongation was carried out for 8 hours, followed by raising the temperature to 95° C. to remove ethyl acetate. After ethyl acetate was fully removed, the liquid was cooled to an ambient temperature and 150 parts by mass of 35% concentrated hydrochloric acid was added to dissolve out tricalcium phosphate on the toner surface. Subsequently, after repeating the process in which solid component was separated from the liquid, the obtained toner cake was dehydrated and the dehydrated toner cake was reslurried in deionized water by three timed, the toner was dried for 24 hours at 40° C. to obtain colored particles [Bk3] in which the content of the aromatic diol-containing polyester segment is higher in the surface portion than in the central portion of each particle.

To 100 parts by mass of obtained colored particles [Bk3], 0.6 part by mass of silica and 1.0 part by mass of hydrophobic titanium oxides were mixed using a Henschel mixer to obtain toner [Bk3]. The mixing was carried out for 20 minutes at 32° C. with the rotary-wing rotor circumferential speed of the Henschel mixer of 35 m/sec, and the toner was passed through a sieve of 45 micrometers of openings pass.

The volume median diameter of toner [Bk3] was 6.0 μm, the average circularity was 0.965, the glass transition temperature (Tg) was 50° C., the softening temperature was 103° C., the number average molecular weight (Mn) was 10,900, the weight average molecular weight was (Mw) was 69,000 and the CV value was 19.

Toner Production Example Y3

Toner [Y3] was prepared in the same manner as toner production example Bk3 except that 8 parts by mass of Pigment Yellow 74 was used instead of 4 parts by mass of copper phthalocyanine blue and 4 parts by mass of carbon black.

The volume median diameter of toner [Y3] was 5.9 μm, the average circularity was 0.971, the glass transition temperature (Tg) was 51° C., the softening temperature was 103° C., the number average molecular weight (Mn) was 10,500, the weight average molecular weight was (Mw) was 69,000 and the CV value was 18.

Toner Production Example M3

Toner [M3] was prepared in the same manner as toner production example Bk3 except that 8 parts by mass of Pigment Red 122 was used instead of 4 parts by mass of copper phthalocyanine blue and 4 parts by mass of carbon black.

The volume median diameter of toner [M3] was 6.2 μm, the average circularity was 0.971 the glass transition temperature (Tg) was 51° C., the softening temperature was 103° C., the number average molecular weight (Mn) was 11,500, the weight average molecular weight was (Mw) was 69,000 and the CV value was 18.

Toner Production Example C3

Toner [C3] was prepared in the same manner as toner production example Bk3 except that 8 parts by mass of copper phthalocyanine blue was used instead of 4 parts by mass of copper phthalocyanine blue and 4 parts by mass of carbon black.

The volume median diameter of toner [C3] was 5.9 μm, the average circularity was 0.971, the glass transition temperature (Tg) was 51° C., the softening temperature was 103° C., the number average molecular weight (Mn) was 11,400, the weight average molecular weight was (Mw) was 69,000 and the CV value was 18.

Toner Production Example Bk4

Production Method (IV)

In a mixing vessel equipped with a reflux condenser and a stirrer, 900 parts by mass of ethylacetate, 300 parts by mass of isocyanate-modified low content aromatic diol-containing polyester [A], 15 parts by mass of a ketimine compound derived from methyl ethyl ketone and hexamethylenediamine, 4 parts by mass of copper phthalocyanine blue, 4 parts by mass of carbon black and 15 parts by mass of pentaerythritoltetrastearate were charged and mixed for 2 hours at a mixing temperature of 20° C. to obtain isocyanate-modified low content aromatic diol-containing polyester composition [A2].

In another reaction vessel, 600 parts by mass of deionized water, 60 parts by mass of methyl ethyl ketone, 60 parts by mass of tricalcium phosphate, and 0.3 part by mass of sodium dodecylbenzenesulfonate were charged. While the mixture was stirred at 30° C. for 3 minutes using a TK type homomixer (produced by a Tokushu Kika Kogyo Co., Ltd.) at 15,000 rpm, the abovementioned isocyanate-modified low content aromatic diol-containing polyester composition [A2] was added to form oil droplets having a number average primary particle diameter of 0.5 μm dispersed in an aqueous medium. After that, the stirrer was changed to a usual stirrer and the temperature of the product was raised to 80° C. while stirring at 300 rpm, followed by stirring for 3 hours to aggregate particles. Thus, central portion-forming particles having a volume median diameter of 6.8 μm were obtained.

Further, in another stirring vessel, a mixed solution of 500 parts by mass of ethylacetate and 300 parts by mass of high content aromatic diol-containing polyester [b], and the mixed solution was dispersed in an aqueous medium containing 600 parts by mass of deionized water, 60 parts by mass of methyl ethyl ketone, 60 parts by mass of tricalcium phosphate and 0.3 part by mass of sodium dodecylbenzenesulfonate, using a TK type homomixer (produced by a Tokushu Kika Kogyo Co., Ltd.) at 15,000 rpm for 2 minutes at a temperature of 30° C. to form oil droplets having a number average primary particle diameter of 0.5 μm. Thus, high content aromatic diol-containing polyester dispersion [b2] was obtained.

The abovementioned liquid containing the central portion-forming particles was transferred to another stirring vessel and 0.3 part by mass of sodium dodecylsulfate was added at 30° C. After that, the above high content aromatic diol-containing polyester dispersion [b2] was added, the temperature was raised to 75° C. and molecule elongation was carried out for 8 hours, followed by raising the temperature to 95° C. to remove ethyl acetate. After ethyl acetate was fully removed, the liquid was cooled to an ambient temperature and 150 parts by mass of 35% concentrated hydrochloric acid was added to dissolve out tricalcium phosphate on the toner surface. Subsequently, after repeating the process in which solid component was separated from the liquid, the obtained toner cake was dehydrated and the dehydrated toner cake was reslurried in deionized water by three timed, the toner was dried for 24 hours at 40° C. to obtain colored particles [Bk4] in which the content of the aromatic diol-containing polyester segment is higher in the surface portion than in the central portion of each particle.

To 100 parts by mass of obtained colored particles [Bk4], 0.6 part by mass of silica and 1.0 part by mass of hydrophobic titanium oxides were mixed using a Henschel mixer to obtain toner [Bk4]. The mixing was carried out for 20 minutes at 32° C. with the rotary-wing rotor circumferential speed of the Henschel mixer of 35 m/sec, and the toner was passed through a sieve of 45 micrometers of openings pass.

The volume median diameter of toner [Bk4] was 6.1 μm, the average circularity was 0.961, the glass transition temperature (Tg) was 50° C., the softening temperature was 103° C., the number average molecular weight (Mn) was 11,000, the weight average molecular weight was (Mw) was 71,000 and the CV value was 17.

Toner Production Example Y4

Toner [Y4] was prepared in the same manner as toner production example Bk4 except that 8 parts by mass of Pigment Yellow 74 was used instead of 4 parts by mass of copper phthalocyanine blue and 4 parts by mass of carbon black.

The volume median diameter of toner [Y4] was 5.8 μm, the average circularity was 0.974, the glass transition temperature (Tg) was 50° C., the softening temperature was 103° C., the number average molecular weight (Mn) was 10,500, the weight average molecular weight was (Mw) was 69,000 and the CV value was 17.

Toner Production Example M4

Toner [M4] was prepared in the same manner as toner production example Bk4 except that 8 parts by mass of Pigment Red 122 was used instead of 4 parts by mass of copper phthalocyanine blue and 4 parts by mass of carbon black.

The volume median diameter of toner [M4] was 6.3 μm, the average circularity was 0.971, the glass transition temperature (Tg) was 50° C., the softening temperature was 103° C., the number average molecular weight (Mn) was 11,500, the weight average molecular weight was (Mw) was 69,000 and the CV value was 18.

Toner Production Example C4

Toner [C4] was prepared in the same manner as toner production example Bk4 except that 8 parts by mass of copper phthalocyanine blue was used instead of 4 parts by mass of copper phthalocyanine blue and 4 parts by mass of carbon black.

The volume median diameter of toner [C4] was 5.9 μm, the average circularity was 0.971, the glass transition temperature (Tg) was 50° C., the softening temperature was 103° C., the number average molecular weight (Mn) was 11,400, the weight average molecular weight was (Mw) was 69,000 and the CV value was 18.

<Synthesis Example of a Crystalline Polyester [c]>

In a 5 L round bottom flask equipped with a thermometer, a stirrer, a nitrogen gas induction tubing and a reflux condenser, 1500 parts by mass of sebacic acid, 964 parts by mass of hexamethylene glycols and 2 parts by mass of dibutyltin oxide were charged, and this reactor was placed in a mantle heater. While the inside of the reactor was maintained in a nitrogen gas atmosphere, the temperature was raised to 150° C., and 13.2 parts by mass of p-toluenesulfonic acid was added to react. When the quantity of the water distilled by this esterification reaction leached to 250 parts by mass, the reaction was stopped, the reaction system was cooled to room temperature, and crystalline polyester [c] containing poly hexamethylene sebacate having a hydroxyl group at the molecular terminal was obtained. The melting point (Tm) of this crystalline polyester [c] was 64° C., the weight average molecular weight (Mw) measured by GPC was 3,500, and the number average molecular weight (Mn) was 2,000.

<The Synthetic Example of an Isocyanate Denaturation Crystalline Polyester [C]>

In a reaction vessel equipped with a stirrer and a nitrogen induction tubing, 2,000 parts by mass of ethylacetates, 1000 parts by mass of crystalline polyester [c] were charged and the temperature was raised to 80° C. After that, 200 parts by mass of isophorone dicyanate was added and reacted for 2 hours to obtain isocyanate-modified crystalline polyester [C].

Toner Production Example Bk5

Production Method (I)

In a mixing vessel equipped with a reflux condenser and a stirrer, 900 parts by mass of ethylacetate, 200 parts by mass of low content aromatic diol-containing polyester [a], 100 parts by mass of crystalline polyester [c], 4 parts by mass of copper phthalocyanine blue, 4 parts by mass of carbon black and 15 parts by mass of pentaerythritoltetrastearate were charged and mixed for 2 hours at a mixing temperature of 20° C. to obtain low content aromatic diol-containing polyester composition [a3].

In another reaction vessel, 600 parts by mass of deionized water, 60 parts by mass of methyl ethyl ketone, 60 parts by mass of tricalcium phosphate, and 0.3 part by mass of sodium dodecylbenzenesulfonate were charged. While the mixture was stirred at 30° C. for 3 minutes using a TK type homomixer (produced by a Tokushu Kika Kogyo Co., Ltd.) at 15,000 rpm, the abovementioned low content aromatic diol-containing polyester composition [a3] was added to form oil droplets having a number average primary particle diameter of 0.5 μm dispersed in an aqueous medium. After that, the stirrer was changed to a usual stirrer and the temperature of the product was raised to 80° C. while stirring at 300 rpm, followed by stirring for 3 hours to aggregate particles. Thus, central portion-forming particles having a volume median diameter of 6.6 μm were obtained.

Further, in another stirring vessel, a mixed solution of 500 parts by mass of ethylacetate, 300 parts by mass of isocyanate-modified high content aromatic diol-containing polyester [B] and 10 parts by mass of isophorone diamine was prepared, and the mixed solution was dispersed in an aqueous medium containing 600 parts by mass of deionized water, 60 parts by mass of methyl ethyl ketone, 60 parts by mass of tricalcium phosphate and 0.3 part by mass of sodium dodecylbenzenesulfonate, using a TK type homomixer (produced by a Tokushu Kika Kogyo Co., Ltd.) at 15,000 rpm for 2 minutes at a temperature of 30° C. to form oil droplets having a number average primary particle diameter of 0.5 μm. Thus, isocyanate-modified high content aromatic diol-containing polyester dispersion [B3] was obtained.

The abovementioned liquid containing the central portion-forming particles was transferred to another stirring vessel and 0.3 part by mass of sodium dodecylsulfate was added at 30° C. After that, the above isocyanate-modified high content aromatic diol-containing polyester dispersion [B3] was added, the temperature was raised to 75° C. and molecule elongation was carried out for 8 hours, followed by raising the temperature to 95° C. to remove ethyl acetate. After ethyl acetate was fully removed, the liquid was cooled to ambient temperature and 150 parts by mass of 35% concentrated hydrochloric acid was added to dissolve out tricalcium phosphate on the toner surface. Subsequently, after repeating the process in which solid component was separated from the liquid, the obtained toner cake was dehydrated and the dehydrated toner cake was reslurried in deionized water by three timed, the toner was dried for 24 hours at 40° C. to obtain colored particles [Bk5] in which the content of the aromatic diol-containing polyester segment is higher in the surface portion than in the central portion of each particle.

To 100 parts by mass of obtained colored particle [Bk5], 0.6 part by mass of silica and 1.0 part by mass of hydrophobic titanium oxides were mixed using a Henschel mixer to obtain toner [Bk1]. The mixing was carried out for 20 minutes at 32° C. with the rotary-wing rotor circumferential speed of the Henschel mixer of 35 m/sec, and the toner was passed through a sieve of 45 micrometers of openings pass.

The volume median diameter of toner [Bk5] was 5.9 μm, the average circularity was 0.968, the glass transition temperature (Tg) was 52° C., the softening temperature was 107° C., the number average molecular weight (Mn) was 10,500, the weight average molecular weight was (Mw) was 63,000 and the CV value was 18.

Toner Production Example Y5

Toner [Y5] was prepared in the same manner as toner production example Bk5 except that 8 parts by mass of Pigment Yellow 74 was used instead of 4 parts by mass of copper phthalocyanine blue and 4 parts by mass of carbon black.

The volume median diameter of toner [Y5] was 5.6 μm, the average circularity was 0.973, the glass transition temperature (Tg) was 52° C., the softening temperature was 107° C., the number average molecular weight (Mn) was 10,500, the weight average molecular weight was (Mw) was 64,000 and the CV value was 17.

Toner Production Example M5

Toner [M5] was prepared in the same manner as toner production example Bk5 except that 8 parts by mass of Pigment Red 122 was used instead of 4 parts by mass of copper phthalocyanine blue and 4 parts by mass of carbon black.

The volume median diameter of toner [M5] was 5.5 μm, the average circularity was 0.974, the glass transition temperature (Tg) was 52° C., the softening temperature was 107° C., the number average molecular weight (Mn) was 10,500, the weight average molecular weight was (Mw) was 63,000 and the CV value was 18.

Toner Production Example C5

Toner [C5] was prepared in the same manner as toner production example Bk5 except that 8 parts by mass of copper phthalocyanine blue was used instead of 4 parts by mass of copper phthalocyanine blue and 4 parts by mass of carbon black.

The volume median diameter of toner [C5] was 5.5 μm, the average circularity was 0.976, the glass transition temperature (Tg) was 52° C., the softening temperature was 107° C., the number average molecular weight (Mn) was 10,800, the weight average molecular weight was (Mw) was 62,100 and the CV value was 18.

Toner Production Example Bk6

Production Method (II)

Toner [Bk6] was obtained in the same manner as toner production example Bk2 except that 150 parts by mass of low content aromatic diol-containing polyester [a] and 150 parts by mass of crystalline polyester [c] were used instead of 300 parts by mass of low content aromatic diol-containing polyester [a].

The volume median diameter of toner [Bk6] was 6.0 μm, the average circularity was 0.978, the glass transition temperature (Tg) was 52° C., the softening temperature was 102° C., the number average molecular weight (Mn) was 10,000, the weight average molecular weight was (Mw) was 63,000 and the CV value was 18.

Toner Production Example Y6

Toner [Y6] was prepared in the same manner as toner production example Bk6 except that 8 parts by mass of Pigment Yellow 74 was used instead of 4 parts by mass of copper phthalocyanine blue and 4 parts by mass of carbon black.

The volume median diameter of toner [Y6] was 5.5 μm, the average circularity was 0.977, the glass transition temperature (Tg) was 52° C., the softening temperature was 102° C., the number average molecular weight (Mn) was 10,100, the weight average molecular weight was (Mw) was 65,000 and the CV value was 17.

Toner Production Example M6

Toner [M6] was prepared in the same manner as toner production example Bk6 except that 8 parts by mass of Pigment Red 122 was used instead of 4 parts by mass of copper phthalocyanine blue and 4 parts by mass of carbon black.

The volume median diameter of toner [M6] was 5.5 μm, the average circularity was 0.972, the glass transition temperature (Tg) was 52° C., the softening temperature was 102° C., the number average molecular weight (Mn) was 10,200, the weight average molecular weight was (Mw) was 67,000 and the CV value was 17.

Toner Production Example C6

Toner [C6] was prepared in the same manner as toner production example Bk6 except that 8 parts by mass of copper phthalocyanine blue was used instead of 4 parts by mass of copper phthalocyanine blue and 4 parts by mass of carbon black.

The volume median diameter of toner [C6] was 5.4 μm, the average circularity was 0.979, the glass transition temperature (Tg) was 52° C., the softening temperature was 102° C., the number average molecular weight (Mn) was 10,400, the weight average molecular weight was (Mw) was 6,000 and the CV value was 19.

Toner Production Example Bk7

Production Method (III)

Toner [Bk7] was obtained in the same manner as toner production example Bk3 except that 150 parts by mass of isocyanate-modified low content aromatic diol-containing polyester [A] and 150 parts by mass of isocyanate-modified crystalline polyester [C] were used instead of 300 parts by mass of isocyanate-modified low content aromatic diol-containing polyester [A].

The volume median diameter of toner [Bk7] was 6.1 μm, the average circularity was 0.973, the glass transition temperature (Tg) was 52° C., the softening temperature was 103° C., the number average molecular weight (Mn) was 10,100, the weight average molecular weight was (Mw) was 64,000 and the CV value was 16.

Toner Production Example Y7

Toner [Y7] was prepared in the same manner as toner production example Bk7 except that 8 parts by mass of Pigment Yellow 74 was used instead of 4 parts by mass of copper phthalocyanine blue and 4 parts by mass of carbon black.

The volume median diameter of toner [Y7] was 5.8 μm, the average circularity was 0.978, the glass transition temperature (Tg) was 52° C., the softening temperature was 103° C., the number average molecular weight (Mn) was 10,100, the weight average molecular weight was (Mw) was 66,000 and the CV value was 18.

Toner Production Example M7

Toner [M7] was prepared in the same manner as toner production example Bk7 except that 8 parts by mass of Pigment Red 122 was used instead of 4 parts by mass of copper phthalocyanine blue and 4 parts by mass of carbon black.

The volume median diameter of toner [M7] was 6.0 μm, the average circularity was 0.976, the glass transition temperature (Tg) was 52° C., the softening temperature was 103° C., the number average molecular weight (Mn) was 10,100, the weight average molecular weight was (Mw) was 65,000 and the CV value was 18.

Toner Production Example C7

Toner [C7] was prepared in the same manner as toner production example Bk7 except that 8 parts by mass of copper phthalocyanine blue was used instead of 4 parts by mass of copper phthalocyanine blue and 4 parts by mass of carbon black.

The volume median diameter of toner [C7] was 5.6 μm, the average circularity was 0.975, the glass transition temperature (Tg) was 52° C., the softening temperature was 103° C., the number average molecular weight (Mn) was 10,100, the weight average molecular weight was (Mw) was 66,700 and the CV value was 17.

Toner Production Example Bk8

Production Method (IV)

Toner [Bk8] was obtained in the same manner as toner production example Bk4 except that 150 parts by mass of isocyanate-modified low content aromatic diol-containing polyester [A] and 150 parts by mass of isocyanate-modified crystalline polyester [C] were used instead of 300 parts by mass of isocyanate-modified low content aromatic diol-containing polyester [A].

The volume median diameter of toner [Bk8] was 5.8 μm, the average circularity was 0.979, the glass transition temperature (Tg) was 52° C., the softening temperature was 105° C., the number average molecular weight (Mn) was 10,100, the weight average molecular weight was (Mw) was 71,000 and the CV value was 17.

Toner Production Example Y8

Toner [Y8] was prepared in the same manner as toner production example Bk8 except that 8 parts by mass of Pigment Yellow 74 was used instead of 4 parts by mass of copper phthalocyanine blue and 4 parts by mass of carbon black.

The volume median diameter of toner [Y8] was 5.8 μm, the average circularity was 0.977; the glass transition temperature (Tg) was 52° C., the softening temperature was 104° C., the number average molecular weight (Mn) was 10,100, the weight average molecular weight was (Mw) was 66,000 and the CV value was 18.

Toner Production Example M8

Toner [M8] was prepared in the same manner as toner production example Bk8 except that 8 parts by mass of Pigment Red 122 was used instead of 4 parts by mass of copper phthalocyanine blue and 4 parts by mass of carbon black.

The volume median diameter of toner [M8] was 5.7 μm, the average circularity was 0.978, the glass transition temperature (Tg) was 52° C., the softening temperature was 104° C., the number average molecular weight (Mn) was 10,500, the weight average molecular weight was (Mw) was 66,000 and the CV value was 17.

Toner Production Example C8

Toner [C8] was prepared in the same manner as toner production example Bk8 except that 8 parts by mass of copper phthalocyanine blue was used instead of 4 parts by mass of copper phthalocyanine blue and 4 parts by mass of carbon black.

The volume median diameter of toner [C8] was 5.6 μm, the average circularity was 0.978, the glass transition temperature (Tg) was 52° C., the softening temperature was 104° C., the number average molecular weight (Mn) was 10,100, the weight average molecular weight was (Mw) was 66,800 and the CV value was 17.

Comparative Toner Production Example Bk9

In the same manner as toner production example Bk1, the central portion-forming particles were prepared and the removal of ethyl acetate was carried out. After that, the solid component was separated from the liquid and the obtained toner cake was dehydrated. Thus comparative toner [Bk9] in which the content of the aromatic diol-containing polyester segment in the surface portion was the same as that in the central portion of each particle was obtained.

The volume median diameter of comparative toner [Bk9] was 4.9 μm, the average circularity was 0.965, the glass transition temperature (Tg) was 47° C., the softening temperature was 106° C., the number average molecular weight (Mn) was 4,000, the weight average molecular weight was (Mw) was 29,000 and the CV value was 18.

Comparative Toner Production Example Y9

Comparative toner [Y9] was prepared in the same manner as comparative toner production example Bk9 except that 8 parts by mass of Pigment Yellow 74 was used instead of 4 parts by mass of copper phthalocyanine blue and 4 parts by mass of carbon black.

The volume median diameter of comparative toner [Y9] was 4.9 μm, the average circularity was 0.964, the glass transition temperature (Tg) was 47° C., the softening temperature was 106° C., the number average molecular weight (Mn) was 4,000, the weight average molecular weight was (Mw) was 29,000 and the CV value was 18.

Comparative Toner Production Example M9

Comparative toner [M9] was prepared in the same manner as comparative toner production example Bk9 except that 8 parts by mass of Pigment Red 122 was used instead of 4 parts by mass of copper phthalocyanine blue and 4 parts by mass of carbon black.

The volume median diameter of comparative toner [M9] was 4.9 μm, the average circularity was 0.968, the glass transition temperature (Tg) was 47° C., the softening temperature was 106° C., the number average molecular weight (Mn) was 4,000, the weight average molecular weight was (Mw) was 29,000 and the CV value was 18.

Comparative Toner Production Example C9

Comparative toner [C9] was prepared in the same manner as comparative toner production example Bk9 except that 8 parts by mass of copper phthalocyanine blue was used instead of 4 parts by mass of copper phthalocyanine blue and 4 parts by mass of carbon black.

The volume median diameter of comparative toner [C9] was 4.9 μm, the average circularity was 0.968, the glass transition temperature (Tg) was 47° C., the softening temperature was 106° C., the number average molecular weight (Mn) was 4,000, the weight average molecular weight was (Mw) was 29,000 and the CV value was 18.

Comparative Toner Production Example Bk10

In the same manner as toner production example Bk2, the central portion-forming particles were prepared and the removal of ethyl acetate was carried out. After that, the solid component was separated from the liquid and the obtained toner cake was dehydrated. Thus comparative toner [Bk10] in which the content of the aromatic diol-containing polyester segment in the surface portion was the same as that in the central portion of each particle was obtained.

The volume median diameter of comparative toner [Bk10] was 5.0 μm, the average circularity was 0.968, the glass transition temperature (Tg) was 47° C., the softening temperature was 108° C., the number average molecular weight (Mn) was 6,000, the weight average molecular weight was (Mw) was 36,000 and the CV value was 18.

Comparative Toner Production Example Y10

Comparative toner [Y10] was prepared in the same manner as comparative toner production example Bk10 except that 8 parts by mass of Pigment Yellow 74 was used instead of 4 parts by mass of copper phthalocyanine blue and 4 parts by mass of carbon black.

The volume median diameter of comparative toner [Y10] was 5.0 μm, the average circularity was 0.968, the glass transition temperature (Tg) was 47° C., the softening temperature was 108° C., the number average molecular weight (Mn) was 6,000, the weight average molecular weight was (Mw) was 36,000 and the CV value was 18.

Comparative Toner Production Example M10

Comparative toner [M10] was prepared in the same manner as comparative toner production example Bk10 except that 8 parts by mass of Pigment Red 122 was used instead of 4 parts by mass of copper phthalocyanine blue and 4 parts by mass of carbon black.

The volume median diameter of comparative toner [M10] was 5.0 μm, the average circularity was 0.968, the glass transition temperature (Tg) was 47° C., the softening temperature was 108° C., the number average molecular weight (Mn) was 6,000, the weight average molecular weight was (Mw) was 36,000 and the CV value was 18.

Comparative Toner Production Example C10

Comparative toner [C10] was prepared in the same manner as comparative toner production example Bk10 except that 8 parts by mass of copper phthalocyanine blue was used instead of 4 parts by mass of copper phthalocyanine blue and 4 parts by mass of carbon black.

The volume median diameter of comparative toner [C10] was 5.0 μm, the average circularity was 0.968, the glass transition temperature (Tg) was 47° C., the softening temperature was 108° C., the number average molecular weight (Mn) was 6,000, the weight average molecular weight was (Mw) was 36,000 and the CV value was 18.

Comparative Toner Production Example Bk11

In the same manner as toner production example Bk3, the central portion-forming particles were prepared and the removal of ethyl acetate was carried out. After that, the solid component was separated from the liquid and the obtained toner cake was dehydrated. Thus comparative toner [Bk11] in which the content of the aromatic diol-containing polyester segment in the surface portion was the same as that in the central portion of each particle was obtained.

The volume median diameter of comparative toner [Bk11] was 4.6 μm, the average circularity was 0.966, the glass transition temperature (Tg) was 48° C., the softening temperature was 109° C., the number average molecular weight (Mn) was 4,300, the weight average molecular weight was (Mw) was 32,000 and the CV value was 19.

Comparative Toner Production Example Y11

Comparative toner [Y11] was prepared in the same manner as comparative toner production example Bk11 except that 8 parts by mass of Pigment Yellow 74 was used instead of 4 parts by mass of copper phthalocyanine blue and 4 parts by mass of carbon black.

The volume median diameter of comparative toner [Y11] was 4.6 μm, the average circularity was 0.966, the glass transition temperature (Tg) was 48° C., the softening temperature was 109° C., the number average molecular weight (Mn) was 4,300, the weight average molecular weight was (Mw) was 32,000 and the CV value was 19.

Comparative Toner Production Example M11

Comparative toner [M11] was prepared in the same manner as comparative toner production example Bk11 except that 8 parts by mass of Pigment Red 122 was used instead of 4 parts by mass of copper phthalocyanine blue and 4 parts by mass of carbon black.

The volume median diameter of comparative toner [M11] was 4.6 μm, the average circularity was 0.966, the glass transition temperature (Tg) was 48° C., the softening temperature was 109° C., the number average molecular weight (Mn) was 4,300, the weight average molecular weight was (Mw) was 32,000 and the CV value was 19.

Comparative Toner Production Example C11

Comparative toner [C11] was prepared in the same manner as comparative toner production example Bk11 except that 8 parts by mass of copper phthalocyanine blue was used instead of 4 parts by mass of copper phthalocyanine blue and 4 parts by mass of carbon black.

The volume median diameter of comparative toner [C11] was 4.6 ρm, the average circularity was 0.966, the glass transition temperature (Tg) was 48° C., the softening temperature was 109° C., the number average molecular weight (Mn) was 4,300, the weight average molecular weight was (Mw) was 32,000 and the CV value was 19.

Comparative Toner Production Example Bk12

In the same manner as toner production example Bk4, the central portion-forming particles were prepared and the removal of ethyl acetate was carried out. After that, the solid component was separated from the liquid and the obtained toner cake was dehydrated. Thus comparative toner [Bk12] in which the content of the aromatic diol-containing polyester segment in the surface portion was the same as that in the central portion of each particle was obtained.

The volume median diameter of comparative toner [Bk12] was 4.9 μm, the average circularity was 0.968, the glass transition temperature (Tg) was 48° C., the softening temperature was 110° C., the number average molecular weight (Mn) was 4,600, the weight average molecular weight was (Mw) was 33,000 and the CV value was 19.

Comparative Toner Production Example Y12

Comparative toner [Y12] was prepared in the same manner as comparative toner production example Bk12 except that 8 parts by mass of Pigment Yellow 74 was used instead of 4 parts by mass of copper phthalocyanine blue and 4 parts by mass of carbon black.

The volume median diameter of comparative toner [Y12] was 4.9 μm, the average circularity was 0.968, the glass transition temperature (Tg) was 48° C., the softening temperature was 110° C., the number average molecular weight (Mn) was 4,600, the weight average molecular weight was (Mw) was 33,000 and the CV value was 19.

Comparative Toner Production Example M12

Comparative toner [M12] was prepared in the same manner as comparative toner production example Bk12 except that 8 parts by mass of Pigment Red 122 was used instead of 4 parts by mass of copper phthalocyanine blue and 4 parts by mass of carbon black.

The volume median diameter of comparative toner [M12] was 4.9 μm, the average circularity was 0.968, the glass transition temperature (Tg) was 48° C., the softening temperature was 110° C., the number average molecular weight (Mn) was 4,600, the weight average molecular weight was (Mw) was 33,000 and the CV value was 19.

Comparative Toner Production Example C12

Comparative toner [C12] was prepared in the same manner as comparative toner production example Bk12 except that 8 parts by mass of copper phthalocyanine blue was used instead of 4 parts by mass of copper phthalocyanine blue and 4 parts by mass of carbon black.

The volume median diameter of comparative toner [C12] was 4.9 μm, the average circularity was 0.968, the glass transition temperature (Tg) was 48° C., the softening temperature was 110° C., the number average molecular weight (Mn) was 4,600, the weight average molecular weight was (Mw) was 33,000 and the CV value was 19.

Comparative Toner Production Example Bk13

In the same manner as toner production example Bk5, the central portion-forming particles were prepared and the removal of ethyl acetate was carried out. After that, the solid component was separated from the liquid and the obtained toner cake was dehydrated. Thus comparative toner [Bk13] in which the content of the aromatic diol-containing polyester segment in the surface portion was the same as that in the central portion of each particle was obtained.

The volume median diameter of comparative toner [Bk13] was 4.8 μm, the average circularity was 0.969, the glass transition temperature (Tg) was 46° C., the softening temperature was 98° C., the number average molecular weight (Mn) was 3,000, the weight average molecular weight was (Mw) was 16,000 and the CV value was 18.

Comparative Toner Production Example Y13

Comparative toner [Y13] was prepared in the same manner as comparative toner production example Bk13 except that 8 parts by mass of Pigment Yellow 74 was used instead of 4 parts by mass of copper phthalocyanine blue and 4 parts by mass of carbon black.

The volume median diameter of comparative toner [Y13] was 4.8 μm, the average circularity was 0.969, the glass transition temperature (Tg) was 46° C., the softening temperature was 98° C., the number average molecular weight (Mn) was 3,000, the weight average molecular weight was (Mw) was 16,000 and the CV value was 18.

Comparative Toner Production Example M13

Comparative toner [M13] was prepared in the same manner as comparative toner production example Bk13 except that 8 parts by mass of Pigment Red 122 was used instead of 4 parts by mass of copper phthalocyanine blue and 4 parts by mass of carbon black.

The volume median diameter of comparative toner [M13] was 4.8 μm, the average circularity was 0.969, the glass transition temperature (Tg) was 46° C., the softening temperature was 98° C., the number average molecular weight (Mn) was 3,000, the weight average molecular weight was (Mw) was 16,000 and the CV value was 18.

Comparative Toner Production Example C13

Comparative toner [C13] was prepared in the same manner as comparative toner production example Bk13 except that 8 parts by mass of copper phthalocyanine blue was used instead of 4 parts by mass of copper phthalocyanine blue and 4 parts by mass of carbon black.

The volume median diameter of comparative toner [C13] was 4.8 μm, the average circularity was 0.969, the glass transition temperature (Tg) was 46° C., the softening temperature was 98° C., the number average molecular weight (Mn) was 3,000, the weight average molecular weight was (Mw) was 16,000 and the CV value was 18.

Comparative Toner Production Example Bk14

In the same manner as toner production example Bk6, the central portion-forming particles were prepared and the removal of ethyl acetate was carried out. After that, the solid component was separated from the liquid and the obtained toner cake was dehydrated. Thus comparative toner [Bk14] in which the content of the aromatic diol-containing polyester segment in the surface portion was the same as that in the central portion of each particle was obtained.

The volume median diameter of comparative toner [Bk14] was 4.7 μm, the average circularity was 0.970, the glass transition temperature (Tg) was 48° C., the softening temperature was 101° C. the number average molecular weight (Mn) was 4,000, the weight average molecular weight was (Mw) was 18,000 and the CV value was 18.

Comparative Toner Production Example Y14

Comparative toner [Y14] was prepared in the same manner as comparative toner production example Bk14 except that 8 parts by mass of Pigment Yellow 74 was used instead of 4 parts by mass of copper phthalocyanine blue and 4 parts by mass of carbon black.

The volume median diameter of comparative toner [Y14] was 4.7 μm, the average circularity was 0.970, the glass transition temperature (Tg) was 48° C., the softening temperature was 101° C., the number average molecular weight (Mn) was 4,000, the weight average molecular weight was (Mw) was 18,000 and the CV value was 18.

Comparative Toner Production Example M14

Comparative toner [M14] was prepared in the same manner as comparative toner production example Bk14 except that 8 parts by mass of Pigment Red 122 was used instead of 4 parts by mass of copper phthalocyanine blue and 4 parts by mass of carbon black.

The volume median diameter of comparative toner [M14] was 4.7 μm, the average circularity was 0.970, the glass transition temperature (Tg) was 48° C., the softening temperature was 101° C., the number average molecular weight (Mn) was 4,000, the weight average molecular weight was (Mw) was 18,000 and the CV value was 18.

Comparative Toner Production Example C14

Comparative toner [C14] was prepared in the same manner as comparative toner production example Bk14 except that 8 parts by mass of copper phthalocyanine blue was used instead of 4 parts by mass of copper phthalocyanine blue and 4 parts by mass of carbon black.

The volume median diameter of comparative toner [C14] was 4.7 μm, the average circularity was 0.970, the glass transition temperature (Tg) was 48° C., the softening temperature was 101° C., the number average molecular weight (Mn) was 4,000, the weight average molecular weight was (Mw) was 18,000 and the CV value was 18.

Comparative Toner Production Example Bk15

In the same manner as toner production example Bk7, the central portion-forming particles were prepared and the removal of ethyl acetate was carried out. After that, the solid component was separated from the liquid and the obtained toner cake was dehydrated. Thus comparative toner [Bk15] in which the content of the aromatic diol-containing polyester segment in the surface portion was the same as that in the central portion of each particle was obtained.

The volume median diameter of comparative toner [Bk15] was 4.8 μm, the average circularity was 0.970, the glass transition temperature (Tg) was 46° C., the softening temperature was 98° C., the number average molecular weight (Mn) was 3,000, the weight average molecular weight was (Mw) was 16,000 and the CV value was 18.

Comparative Toner Production Example Y15

Comparative toner [Y15] was prepared in the same manner as comparative toner production example Bk15 except that 8 parts by mass of Pigment Yellow 74 was used instead of 4 parts by mass of copper phthalocyanine blue and 4 parts by mass of carbon black.

The volume median diameter of comparative toner [Y15] was 4.8 μm, the average circularity was 0.970, the glass transition temperature (Tg) was 46° C., the softening temperature was 98° C., the number average molecular weight (Mn) was 3,000, the weight average molecular weight was (Mw) was 16,000 and the CV value was 18.

Comparative Toner Production Example M15

Comparative toner [M15] was prepared in the same manner as comparative toner production example Bk15 except that 8 parts by mass of Pigment Red 122 was used instead of 4 parts by mass of copper phthalocyanine blue and 4 parts by mass of carbon black.

The volume median diameter of comparative toner [M15] was 4.8 μm, the average circularity was 0.970, the glass transition temperature (Tg) was 46° C., the softening temperature was 98° C., the number average molecular weight (Mn) was 3,000, the weight average molecular weight was (Mw) was 16,000 and the CV value was 18.

Comparative Toner Production Example C15

Comparative toner [C15] was prepared in the same manner as comparative toner production example Bk15 except that 8 parts by mass of copper phthalocyanine blue was used instead of 4 parts by mass of copper phthalocyanine blue and 4 parts by mass of carbon black.

The volume median diameter of comparative toner [C15] was 4.8 μm, the average circularity was 0.970, the glass transition temperature (Tg) was 46° C., the softening temperature was 98° C., the number average molecular weight (Mn) was 3,000, the weight average molecular weight was (Mw) was 16,000 and the CV value was 18.

Comparative Toner Production Example Bk15

In the same manner as toner production example Bk8, the central portion-forming particles were prepared and the removal of ethyl acetate was carried out. After that, the solid component was separated from the liquid and the obtained toner cake was dehydrated. Thus comparative toner [Bk16] in which the content of the aromatic diol-containing polyester segment in the surface portion was the same as that in the central portion of each particle was obtained.

The volume median diameter of comparative toner [Bk16] was 4.9 μm, the average circularity was 0.968, the glass transition temperature (Tg) was 48° C., the softening temperature was 102° C., the number average molecular weight (Mn) was 4,300, the weight average molecular weight was (Mw) was 19,000 and the CV value was 18.

Comparative Toner Production Example Y16

Comparative toner [Y16] was prepared in the same manner as comparative toner production example Bk16 except that 8 parts by mass of Pigment Yellow 74 was used instead of 4 parts by mass of copper phthalocyanine blue and 4 parts by mass of carbon black.

The volume median diameter of comparative toner [Y16] was 4.9 μm, the average circularity was 0.968, the glass transition temperature (Tg) was 48° C., the softening temperature was 102° C., the number average molecular weight (Mn) was 4,300, the weight average molecular weight was (Mw) was 19,000 and the CV value was 18.

Comparative Toner Production Example M16

Comparative toner [M16] was prepared in the same manner as comparative toner production example Bk16 except that 8 parts by mass of Pigment Red 122 was used instead of 4 parts by mass of copper phthalocyanine blue and 4 parts by mass of carbon black.

The volume median diameter of comparative toner [M16] was 4.9 μm, the average circularity was 0.968, the glass transition temperature (Tg) was 48° C., the softening temperature was 102° C., the number average molecular weight (Mn) was 4,300, the weight average molecular weight was (Mw) was 19,000 and the CV value was 18.

Comparative Toner Production Example C16

Comparative toner [C16] was prepared in the same manner as comparative toner production example Bk16 except that 8 parts by mass of copper phthalocyanine blue was used instead of 4 parts by mass of copper phthalocyanine blue and 4 parts by mass of carbon black.

The volume median diameter of comparative toner [C16] was 4.9 μm, the average circularity was 0.968, the glass transition temperature (Tg) was 48° C., the softening temperature was 102° C., the number average molecular weight (Mn) was 4,300, the weight average molecular weight was (Mw) was 19,000 and the CV value was 18.

Examples 1-8 and Comparative Examples 1-8

Low-temperature fixability, heat-resistant storage properties, and high-speed fixability of a full-color image were evaluated via the following method. The results are listed in Table 1.

(Evaluation of Heat-Resistant Storage Properties)

Using Toners (Bk1)-(C8) and Comparative Toners (Bk9)-(C16) in the combinations shown in Table 1, 21 samples were prepared for each of Examples 1-8 and Comparative Examples 18, by placing 5 g of the toner of each color in a glass sample tube of 2 cm diameter. For each of Examples 1-8 and Comparative Examples 1-8, 21 samples were stored one by one at 21 temperatures of 40° C., 41° C., 42° C., . . . 60° C., under a condition of a relative humidity of 50% RH for 24 hours. Then, the toner of each sample was sifted through a 100-mesh sieves and when the amount of the toner passed through the sieve became less than 2.5 g, the storage temperature was designated as the heat-resistant storage temperature.

A higher heat-resistant storage temperature gives a higher heat-resistant storage stability. In practice, the heat-resistant storage temperature is preferably 58° C. or more.

(Production Example of a Carrier)

A coating agent containing 85 parts by mass of a silicone resin (an oxime-curing type in a toluene solution) in terms of a solid content, 10 parts by mass of γ-aminopropyltrimethoxysilane (a coupling agent), and 3 parts by mass of alumina particles (a particle diameter of 100 μm), as well as 2 parts by mass of carbon black, was spray-coated on manganese-magnesium ferrite of a 50 μm weight average particle diameter, followed by being fired at 190° C. for 6 hours. Subsequently, the resultant substance was cooled down to room temperature to give a resin-coating type carrier. The average film thickness of the resin coat was 0.2 μm.

(Production Example of a Developer)

Using a V type mixer, 94 parts by mass of the thus prepared carrier and 6 parts by mass of each of Toners (Bk1)-(C8) and Comparative Toners (Bk9)-(C16) prepared above were mixed to give Developers (Bk1)-(C8) and Comparative Developers (Bk9)-(C16), respectively. Incidentally, in the mixing treatment, when a charge amount of the toner reached 20-30 μC/g, the mixing was stopped and the mixture was discharged into a polyethylene pot temporarily.

(Evaluation of Low-Temperature Fixability)

Using Developers (Bk1)-(C8) and Comparative Developers (Bk9)-(C16) in the combinations shown in Table 1, a full-color image having a 10% color pixel density (color pixel density representing a ratio of the total area of colored pixels based on the total area of the recording sheet) of each color was produced employing digital copier "bizhub C500" (produced by Konica Minolta Business Technologies, Inc.) under a low-temperature and humidity (temperature: 10° C.; humidity: 20% RH) wherein the print speed was set to 51 sheets/min in a state where A4-size plain paper was fed in the lateral direction, and the fixing temperature (namely the surface temperature of the fixing roller) of the fixing device was set to 120° C. Then, this full-color image was rubbed 10 times at a velocity of 20 cm/sec using a 1 kg weight of a 3 cm diameter wound with "bleached cotton". In the portion of the bleached cotton where the image was rubbed with the weight, 5 locations were randomly selected to measure each reflection density using densitometer "RD-918" (Gretag Macbeth AG.), and then the arithmetic average value was calculated to obtain the stain density. Herein, the reflection density refers to the relative reflection density when the reflection density of "bleached cotton" is set to "0."

(High-Speed Fixability: Stain After 20,000-Sheet Printing)

Using Developers (Bk1)-(C8) and Comparative Developers (Bk9)-(C16) in the combinations shown in Table 1, a full-color image having a 10% color pixel density of each color was continuously printed onto 20,000 sheets of paper employing digital copier "bizhub C500" (produced by Konica Minolta Business Technologies, Inc.) under a low-temperature and humidity (temperature: 10° C.; humidity: 20% RH) at a print speed of 51 sheets/min using A4-size plain paper. Then, after the machine had been allowed to remain unoperated for one day, a solid white image having a 0% color pixel density of each of the individual colors was printed onto a sheet of paper, and the presence of stains stemming from the fixed image was visually observed to evaluate high-speed fixability of the full-color image.

TABLE 1

| | Combination of Developer | Evaluation Result: Low-temperature Fixability | Heat-resistant Storage Temperature | High-speed Fixability: Stain after 20,000-sheet Printing |
|---|---|---|---|---|
| Example 1 | Bk1/Y1/M1/C1 | 0 | 60° C. | Absent |
| Example 2 | Bk2/Y2/M2/C2 | 0.001 | 60° C. | Absent |
| Example 3 | Bk3/Y3/M3/C3 | 0.001 | 60° C. | Absent |
| Example 4 | Bk4/Y4/M4/C4 | 0 | 60° C. | Absent |
| Example 5 | Bk5/Y5/M5/C5 | 0 | 60° C. | absent |
| Example 6 | Bk6/Y6/M6/C6 | 0 | 60° C. | Absent |
| Example 7 | Bk7/Y7/M7/C7 | 0 | 60° C. | Absent |
| Example 8 | Bk8/Y8/M8/C8 | 0 | 60° C. | Absent |
| Comparative Example 1 | Bk9/Y9/M9/C9 | 0.012 | 56° C. | Slightly generated |
| Comparative Example 2 | Bk10/Y10/M10/C10 | 0.012 | 56° C. | Slightly generated |
| Comparative Example 3 | Bk11/Y11/M11/C11 | 0.012 | 56° C. | Slightly generated |
| Comparative Example 4 | Bk12/Y12/M12/C12 | 0.011 | 56° C. | Slightly generated |
| Comparative Example 5 | Bk13/Y13/M13/C13 | 0.01 | 54° C. | Slightly generated |
| Comparative Example 6 | Bk14/Y14/M14/C14 | 0.009 | 54° C. | Slightly generated |
| Comparative Example 7 | Bk15/Y15/M15/C15 | 0.01 | 53° C. | Slightly generated |
| Comparative Example 8 | Bk16/Y16/M16/C16 | 0.01 | 54° C. | Slightly generated |

Table 1 clearly confirmed that the toners according to Examples 1-8 exhibited excellent heat-resistant storage properties and excellent low-temperature fixability, as well as stable high-speed fixability for a long period of time.

What is claimed is:

1. A toner comprising toner particles containing a colorant and a binder resin, the binder resin comprising a polyester resin, wherein the polyester resin comprises at least a polyester segment containing an aromatic diol component, the polyester segment being derived from an aromatic diol and a dicarboxylic acid, wherein a content of the polyester segment containing an aromatic diol component is higher in a surface-portion of the toner particle than in a central portion of the toner particle.

2. The toner of claim 1, wherein the polyester resin comprises a urea modified polyester resin.

3. A method of producing a toner comprising the steps of:

(i) dispersing polyester composition (a1) in an aqueous medium, polyester composition (a1) comprising a colorants a solvent and central-portion forming polyester (a) which comprises at least a polyester segment containing an aromatic diol component, wherein the polyester segment is derived from an aromatic diol and a dicarboxylic acid, whereby an aqueous dispersion of oil droplets containing central-portion forming polyester (a) and the colorant is obtained; and (ii) adding surface-portion forming composition (B1) to the aqueous dispersion, surface-portion forming composition (B1) comprising an amine cross-linking agent, a solvent and isocyanate modified surface-portion forming polyester (B) which comprises at least the polyester segment containing the aromatic diol component, whereby central-portion forming polyester (a) is covered by isocyanate modified surface-portion forming polyester (B) to form toner particles, wherein a content of the polyester segment containing the aromatic diol component is higher in isocyanate modified surface-portion forming polyester (B) than in central-portion forming polyester (a).

4. The method of claim 3 further comprising the step of aggregating the oil droplets after step (i).

5. A method of producing a toner comprising the steps of:

(i) dispersing polyester composition (a2) in an aqueous medium, polyester composition (a2) comprising a colorant, an amine cross-linking agent, a solvent and central-portion forming polyester (a) which comprises at least a polyester segment containing an aromatic diol component, wherein the polyester segment is derived from an aromatic diol and a dicarboxylic acid, whereby an aqueous dispersion of oil droplets containing central-portion forming polyester (a) and the colorant is obtained; and (ii) adding surface-portion forming composition (B2) to the aqueous dispersion, surface-portion forming composition (B2) comprising a solvent and isocyanate modified surface-portion forming polyester (B) which comprises at least the polyester segment containing the aromatic diol component, whereby central-portion forming polyester (a) is covered by isocyanate modified surface-portion forming polyester (B) to form toner particles wherein a content of the polyester segment containing the aromatic diol component is higher in isocyanate modified surface-portion forming polyester (B) than in central-portion forming polyester (a).

6. The method of claim 5 further comprising the step of aggregating the oil droplets after step (i).

7. A method of producing a toner comprising the steps of:

(i) dispersing polyester composition (A1) in an aqueous medium, polyester composition (A1) comprising a colorant, a solvent and isocyanate modified central-portion forming polyester (A) which comprises at least a polyester segment containing an aromatic diol component, wherein the polyester segment is derived from an aromatic diol and a dicarboxylic acid, whereby an aqueous dispersion of oil droplets containing isocyanate modified central-portion forming polyester (A) and the colorant is obtained; and (ii) adding surface-portion forming composition (b1) to the aqueous dispersion, surface-portion forming composition (b1) comprising a solvent, an amine cross-linking agent, and surface-portion forming polyester (b) which comprises at least the polyester segment containing the aromatic diol component, whereby isocyanate modified central-portion forming polyester (A) is covered by surface-portion forming polyester (b) to form toner particles, wherein a content of the polyester segment containing the aromatic diol component is higher in surface-portion forming polyester (b) than in isocyanate modified central-portion forming polyester (A).

8. The method of claim 7 further comprising the step of aggregating the oil droplets after step (i).

9. A method of producing a toner comprising the steps of:

(i) dispersing polyester composition (A2) in an aqueous medium, polyester composition (A2) comprising a colorant, an amine cross-linking agent, a solvent and isocyanate modified central-portion forming polyester (A) which comprises at least a polyester segment containing an aromatic diol component, wherein the polyester segment is derived from an aromatic diol and a dicarboxylic acid, whereby an aqueous dispersion of oil droplets containing isocyanate modified central-portion forming polyester (A) and the colorant is obtained; and (ii) adding surface-portion forming composition (b1) to the aqueous dispersion, surface-portion forming composition (b1) comprising a solvent and surface-portion forming polyester (b) which comprises at least the polyester segment containing the aromatic diol component, whereby isocyanate modified central-portion forming polyester (A) is covered by surface-portion forming polyester (b) to form toner particles, wherein a content of the polyester segment containing the aromatic diol component is higher in surface-portion forming polyester (b) than in isocyanate modified central-portion forming polyester (A).

10. The method of claim 9 further comprising the step of aggregating the oil droplets after step (i).

* * * * *